US010256931B2

(12) United States Patent
Fuller et al.

(10) Patent No.: US 10,256,931 B2
(45) **Date of Patent: *Apr. 9, 2019**

(54) SYSTEMS AND METHODS FOR DETECTION OF SIGNAL QUALITY IN DIGITAL RADIO BROADCAST SIGNALS

(71) Applicant: Ibiquity Digital Corporation, Columbia, MD (US)

(72) Inventors: Desmond S Fuller, Columbia, MD (US); Paul Venezia, Keene, NH (US); Harvey Chalmers, Rockville, MD (US)

(73) Assignee: Ibiquity Digital Corporation, Columbia, MD (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/849,729

(22) Filed: Dec. 21, 2017

(65) Prior Publication Data

US 2018/0205472 A1 Jul. 19, 2018

Related U.S. Application Data

(63) Continuation of application No. 15/094,529, filed on Apr. 8, 2016, now Pat. No. 9,876,592.
(Continued)

(51) Int. Cl.
*H04H 20/12* (2008.01)
*H04H 60/29* (2008.01)

(52) U.S. Cl.
CPC ..... *H04H 20/12* (2013.01); *H04H 60/29* (2013.01); *H04H 2201/20* (2013.01)

(58) Field of Classification Search
CPC ..... H04H 20/12; H04H 60/29; H04H 2201/20
See application file for complete search history.

(56) References Cited

U.S. PATENT DOCUMENTS 5,319,673 A 6/1994 Briskman
5,576,755 A 11/1996 Davis et al.
(Continued)

OTHER PUBLICATIONS

"U.S. Appl. No. 15/094,529, Notice of Allowance dated Sep. 27, 2017", 9 pgs.
(Continued)

*Primary Examiner* — Duc C Ho
(74) *Attorney, Agent, or Firm* — Schwegman Lundberg & Woessner, P.A.

(57) ABSTRACT

Systems, methods, and processor readable media are disclosed for detection of signal quality problems and errors in digital radio broadcast signals. First monitoring equipment is located in an over-the-air coverage area of a first radio station. Second monitoring equipment is located in an over-the-air coverage area of a second radio station. The first and second monitoring equipment are configured to receive digital radio broadcast signals from the respective first and second radio stations. A computing system is configured to receive data from the first monitoring equipment and the second monitoring equipment, the data being indicative of one or more attributes of a digital radio broadcast signal received at respective monitoring equipment. The computing system analyzes received data to detect a signal quality problem or error in the digital radio broadcast signals received at the first and second monitoring equipment.

20 Claims, 19 Drawing Sheets

Related U.S. Application Data

(60) Provisional application No. 62/145,000, filed on Apr. 9, 2015.

(56) References Cited

U.S. PATENT DOCUMENTS

| | | | |
|---|---|---|---|
| 5,790,958 | A | 8/1998 | Mccoy et al. |
| 6,628,928 | B1 | 9/2003 | Crosby et al. |
| 6,799,294 | B1 | 9/2004 | Chung et al. |
| 7,580,708 | B1 | 8/2009 | Barrett |
| 7,617,310 | B2 | 11/2009 | Reitmeier et al. |
| 8,346,230 | B2 | 1/2013 | Goodmon et al. |
| 8,604,910 | B2 | 12/2013 | Howarth |
| 8,875,188 | B2 | 10/2014 | Christensen et al. |
| 9,648,282 | B2 | 5/2017 | Petrovic et al. |
| 2004/0133420 | A1 | 7/2004 | Ferris et al. |
| 2005/0037711 | A1 | 2/2005 | Pesme |
| 2006/0020996 | A1* | 1/2006 | Takagi ..... H04N 21/42607 725/124 |
| 2007/0016488 | A1 | 1/2007 | Ulenas |
| 2007/0060184 | A1* | 3/2007 | Nakamura ..... H04L 1/206 455/522 |
| 2007/0217551 | A1 | 9/2007 | Kang et al. |
| 2008/0072268 | A1 | 3/2008 | Mitsuhashi |
| 2016/0302093 | A1 | 10/2016 | Fuller et al. |

OTHER PUBLICATIONS

"International Application Serial No. PCT/US2016/026684, International Preliminary Report on Patentability dated Oct. 19, 2017", 10 pgs.
"International Application Serial No. PCT/US2016/026684, International Search Report dated Jul. 14, 2016", 2 pgs.
"International Application Serial No. PCT/US2016/026684, Written Opinion dated Jul. 14, 2016", 8 pgs.

* cited by examiner 92.3FM-WBMP-FM New York

| | | | |
|---|---|---|---|
| -850 | -76 | 67 | here |
| Time Alignment (Samples) | Analog Strength | Digital Strength | Data Provider |
| -1.30 | WBMP-FM | | True |
| Level Alignment | Station Name | | HD Acquired |
| 0.80 | | | HD1, HD2 |
| Phase Alignment (Correlation) | Station Slogan | | Available HD Channels |

HD1

| | |
|---|---|
| Earned It | The Weekend |
| Title | Artist |
| The 'Fifty Shades Of Grey' Soundtrack | Top 40 |
| Album | Program Type |

Artist Experience  Station Logo

HD2

| | |
|---|---|
| It's Going Down | The X-Ecutioners |
| Title | Artist |
| Built From Scratch | |
| Album | Program Type |

Latest Result
2015-03-30-12:30)

about 1 hour ago
2015-03-30-11:59 about 1 hour ago
2015-03-30-11:22 about 2 hours ago
2015-03-30-10:54 about 2 hours ago
2015-03-30-10:24 about 3 hours ago
2015-03-30-09:54 about 3 hours ago
2015-03-30-09:23 about 4 hours ago
2015-03-30-08:50 about 5 hours ago
2015-03-30-08:19 about 5 hours ago
2015-03-30-07:48 about 6 hours ago
2015-03-30-07:17 about 6 hours ago
2015-03-30-06:45 about 7 hours ago

*Fig. 16*

SYSTEMS AND METHODS FOR DETECTION OF SIGNAL QUALITY IN DIGITAL RADIO BROADCAST SIGNALS

CROSS-REFERENCE TO RELATED APPLICATIONS

This application is a Continuation of U.S. patent application Ser. No. 15/094,529, filed Apr. 8, 2016, entitled "Systems and Methods for Detection of Signal Quality in Digital Radio Broadcast Signals, which claims priority to U.S. Provisional Patent Application No. 62/145,000, filed Apr. 9, 2015, entitled "Systems and Methods for Automated Detection of Signal Quality Problems in Digital Radio Broadcast Signals," the contents of which are incorporated herein by reference in their entirety.

BACKGROUND

Field of the Disclosure

The present disclosure relates to systems and methods for detection of signal quality problems in digital radio broadcast signals.

Background Information

Digital radio broadcasting technology delivers digital audio and data services to mobile, portable, and fixed receivers. One type of digital radio broadcasting, referred to as in-band on-channel (IBOC) digital audio broadcasting (DAB), uses terrestrial transmitters in the existing Medium Frequency (MF) and Very High Frequency (VHF) radio bands. HD Radio™ technology, developed by iBiquity Digital Corporation, is one example of an IBOC implementation for digital radio broadcasting and reception.

IBOC digital radio broadcasting signals can be transmitted in a hybrid format including an analog modulated carrier in combination with a plurality of digitally modulated carriers or in an all-digital format wherein the analog modulated carrier is not used. Using the hybrid mode, broadcasters may continue to transmit analog AM and FM simultaneously with higher-quality and more robust digital signals, allowing themselves and their listeners to convert from analog-to-digital radio while maintaining their current frequency allocations.

One feature of digital transmission systems is the inherent ability to simultaneously transmit both digitized audio and data. Thus the technology also allows for wireless data services from AM and FM radio stations. The broadcast signals can include metadata, such as the artist, song title, or station call letters. Special messages about events, traffic, and weather can also be included. For example, traffic information, weather forecasts, news, and sports scores can all be scrolled across a radio receiver's display while the user listens to a radio station.

IBOC digital radio broadcasting technology can provide digital quality audio, superior to existing analog broadcasting formats. Because each IBOC digital radio broadcasting signal is transmitted within the spectral mask of an existing AM or FM channel allocation, it requires no new spectral allocations. IBOC digital radio broadcasting promotes economy of spectrum while enabling broadcasters to supply digital quality audio to the present base of listeners.

Multicasting, the ability to deliver several audio programs or services over one channel in the AM or FM spectrum, enables stations to broadcast multiple services and supplemental programs on any of the sub-channels of the main frequency. For example, multiple data services can include alternative music formats, local traffic, weather, news, and sports. The supplemental services and programs can be accessed in the same manner as the traditional station frequency using tuning or seeking functions. For example, if the analog modulated signal is centered at 94.1 MHz, the same broadcast in IBOC can include supplemental services 94.1-2, and 94.1-3. Highly specialized supplemental programming can be delivered to tightly targeted audiences, creating more opportunities for advertisers to integrate their brand with program content. As used herein, multicasting includes the transmission of one or more programs in a single digital radio broadcasting channel or on a single digital radio broadcasting signal. Multicast content can include a main program service (MPS), supplemental program services (SPS), program service data (PSD), and/or other broadcast data.

The National Radio Systems Committee, a standard-setting organization sponsored by the National Association of Broadcasters and the Consumer Electronics Association, adopted an IBOC standard, designated NRSC-5, in September 2005. NRSC-5 and its updates (e.g., the NRSC-5C standard, adopted in September 2011) the disclosure of which are incorporated herein by reference, set forth the requirements for broadcasting digital audio and ancillary data over AM and FM broadcast channels. The standard and its reference documents contain detailed explanations of the RF/transmission subsystem and the transport and service multiplex subsystems. Copies of the standard can be obtained from the NRSC at http://www.nrscstandards.org/SG.asp. iBiquity's HD Radio™ technology is an implementation of the NRSC-5 IBOC standard. Further information regarding HD Radio technology can be found at www.hdradio.com and www.ibiquity.com.

Other types of digital radio broadcasting systems include satellite systems such as Satellite Digital Audio Radio Service (SDARS, e.g., XM Radio, Sirius), Digital Audio Radio Service (DARS, e.g., WorldSpace), and terrestrial systems such as Digital Radio Mondiale (DRM), Eureka 147 (branded as DAB Digital Audio Broadcasting), DAB Version 2, and FMeXtra. As used herein, the phrase "digital radio broadcasting" encompasses digital audio broadcasting including in-band on-channel broadcasting, as well as other digital terrestrial broadcasting and satellite broadcasting.

SUMMARY

The present inventors have observed a need for improved approaches for detecting signal quality problems and errors (e.g., errors in content, non-adherence to broadcasting standards, etc.) in digital radio broadcast signals. The present inventors have further observed a need for improved approaches to detecting problems in digital radio broadcast transmitter and receiver systems. In particular, the present inventors have observed that, with the increasing use of HD Radio™ broadcasting, some radio stations may not be optimally configured for broadcasting a highest quality digital radio broadcasting signal. Further, some radio stations may broadcast signals that are not compliant with applicable digital radio broadcast standards and/or that do not include the correct content, among other issues. These issues may negatively affect the experience of end-users (e.g., consumers), who may experience less than desired audio quality (e.g., echo, distortion, feedback, inadequate volume, etc.), among other possible problems (e.g., artist, song, or album information that does not match a song currently playing, incorrect or missing station logo, etc.). The present inventors have observed a need to detect such issues with digital radio broadcast signals. Problems related to a digital radio broadcast receiver system's hardware, software, or firmware may also cause end-users to have less than optimal experiences. Such problems may cause the receiver system to experience a fault (e.g., fail to render audio or visual data properly, fail to receive broadcasted data, etc.) despite the fact that broadcasted signals are error-free and include the correct content. The present inventors have observed a need to detect such problems related to digital radio broadcast receiver systems.

To investigate such problems related to digital radio broadcast signals, transmitter systems, and/or receiver systems, a radio engineer could travel to the location of the radio station (e.g., traveling to a geographical area in which the radio station's digital radio broadcast signals can be received) with various expensive equipment and use the equipment to monitor and record the radio station's broadcasts in the field. The radio engineer could then bring the recorded data to another location for analysis. The recorded data could be analyzed in various ways and/or tested on different receiver systems, for example. The present inventors have observed that such an approach may have deficiencies insofar as such an assessment could require a considerable amount of time (e.g., hours or days, etc.), permit an engineer to assess only one station at a time, and require travel to various geographic locations, all of which can be expensive.

Embodiments of the present disclosure are directed to systems and methods that may satisfy these needs.

According to exemplary embodiments, a computer-implemented system for automated detection of signal quality problems and errors in digital radio broadcast signals is disclosed. The system may include first monitoring equipment located in an over-the-air coverage area of a first radio station. The first monitoring equipment is configured to receive a digital radio broadcast signal via digital radio broadcast transmission from the first radio station. The system may also include second monitoring equipment located in an over-the-air coverage area of a second radio station. The second monitoring equipment is configured to receive a digital radio broadcast signal via digital radio broadcast transmission from the second radio station, where the over-the-air coverage areas of the first and second radio stations are different. A computing system is configured to receive data from the first monitoring equipment and the second monitoring equipment, the data being indicative of one or more attributes of a digital radio broadcast signal received at respective monitoring equipment. The computing system analyzes in real-time or near real-time the received data from the first and second monitoring equipment. The data is analyzed in an automated manner to detect a signal quality problem or error in the digital radio broadcast signals received at the first and second monitoring equipment.

Additionally, a method for detection of signal quality problems and errors in digital radio broadcast signals is disclosed. Using first monitoring equipment located in an over-the-air coverage area of a first radio station, a digital radio broadcast signal is received via digital radio broadcast transmission from the first radio station. Using second monitoring equipment located in an over-the-air coverage area of a second radio station, a digital radio broadcast signal is received via digital radio broadcast transmission from the second radio station. The over-the-air coverage areas of the first and second radio stations are different. Data from the first monitoring equipment and the second monitoring equipment are received, the data being indicative of one or more attributes of a digital radio broadcast signal received at respective monitoring equipment. The received data is analyzed in real-time or near real-time to detect a signal quality problem or error in the digital radio broadcast signals received at the first and second monitoring equipment.

Further, according to exemplary embodiments, a system for automated detection of signal quality problems and errors in digital radio broadcast signals is disclosed. The system includes first means for receiving a digital radio broadcast signal via digital radio broadcast transmission from a first radio station in an over-the-air coverage area of the first radio station. The system includes second means for receiving a digital radio broadcast signal via digital radio broadcast transmission from a second radio station in an over-the-air coverage area of the second radio station. The over-the-air coverage areas of the first and second radio stations are different. The system further includes third means for receiving data from the first means for receiving and the second means for receiving, the data being indicative of one or more attributes of a digital radio broadcast signal received at respective means for receiving. The system further includes means for analyzing in real-time or near real-time the received data from the first means for receiving and the second means for receiving. The data being analyzed by the means for analyzing in an automated manner to detect a signal quality problem or error in the digital radio broadcast signals received at the first means for receiving and the second means for receiving.

Further, according to exemplary embodiments, a computer-implemented system for automated detection of signal quality problems and errors in digital radio broadcast signals is disclosed. The system includes first monitoring equipment located in an over-the-air coverage area of a first radio station. The first monitoring equipment is configured to receive a digital radio broadcast signal via digital radio broadcast transmission from the first radio station. The system also includes second monitoring equipment located in an over-the-air coverage area of a second radio station. The second monitoring equipment is configured to receive a digital radio broadcast signal via digital radio broadcast transmission from the second radio station, where the over-the-air coverage areas of the first and second radio stations are different. A computing system is configured to receive data from the first monitoring equipment and the second monitoring equipment, the data being indicative of one or more attributes of a digital radio broadcast signal received at respective monitoring equipment. The received data is stored in a database. Each piece of data stored in the database has an associated (i) date and time, (ii) broadcast frequency, and (iii) location information. The computing system analyzes the data stored in the database in an automated manner.

BRIEF DESCRIPTION OF THE DRAWINGS

These and other features, aspects, and advantages of the present disclosure will become better understood with regard to the following description, appended claims, and accompanying drawings wherein:

FIGS. 14-16 are exemplary screenshots of a GUI that may be used to present data received at an HD Radio Data Request and Filing Server and results of an analysis of that data.

DESCRIPTION

Figure 1:
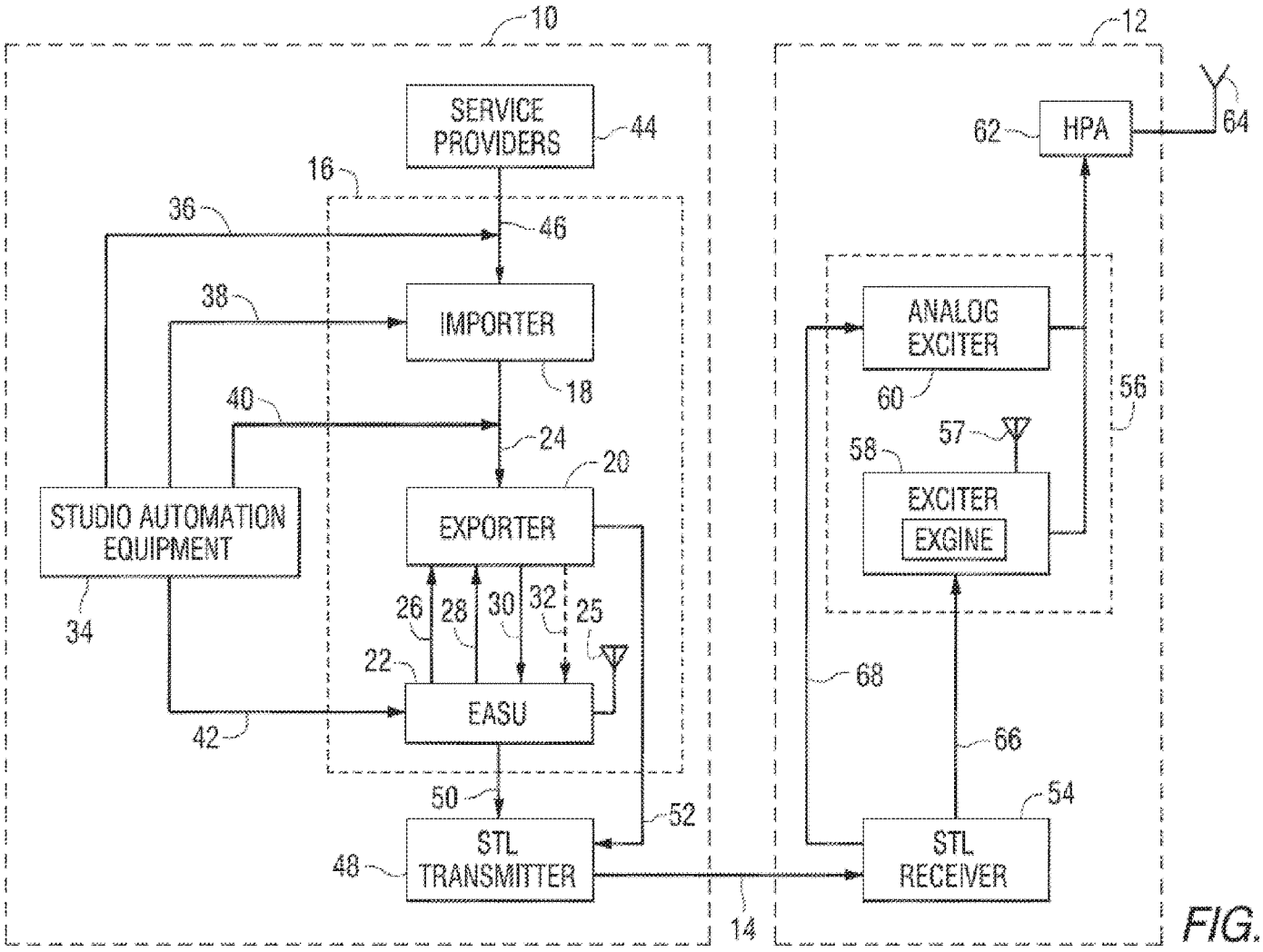
FIG. 1 illustrates a block diagram that provides an overview of a system in accordance with certain embodiments.

In digital radio broadcasting systems, issues at the broadcasting side or the receiving side may cause problems that can negatively affect an end-user's experience. The present inventors have developed novel systems and methods that automate the detection of such issues, thus overcoming the inefficiencies of conventional systems and methods directed to this purpose.

Exemplary Digital Radio Broadcasting System

FIGS. 1-10 and the accompanying description herein provide a general description of an exemplary IBOC system, exemplary broadcasting equipment structure and operation, and exemplary receiver structure and operation. FIGS. 11-16 and the accompanying description herein provide a detailed description of exemplary approaches for systems and methods for automated detection of signal quality problems and errors (e.g., errors in content, non-compliance with broadcasting standards, etc.) in digital radio broadcast signals in accordance with exemplary embodiments of the present disclosure. These approaches may further be used to detect problems in digital radio broadcast transmitter and receiver systems (e.g., software, hardware, and/or firmware issues, etc.). Whereas aspects of the disclosure are presented in the context of an exemplary IBOC system, it should be understood that the present disclosure is not limited to IBOC systems and that the teachings herein are applicable to other forms of digital radio broadcasting as well.

As referred to herein, a service is any analog or digital medium for communicating content via radio frequency broadcast. For example, in an IBOC radio signal, the analog modulated signal, the digital main program service, and the digital supplemental program services could all be considered services. Other examples of services can include conditionally accessed programs (CAs), which are programs that require a specific access code and can be both audio and/or data such as, for example, a broadcast of a game, concert, or traffic update service, and data services, such as traffic data, multimedia and other files, and service information guides (SIGs).

Additionally, as referred to herein, media content is any substantive information or creative material, including, for example, audio, video, text, image, or metadata, that is suitable for processing by a processing system to be rendered, displayed, played back, and/or used by a human.

Furthermore, one of ordinary skill in the art would appreciate that what amounts to synchronization can depend on the particular implementation. As a general matter, two pieces of content are synchronized if they make sense in temporal relation to one another when rendered to a listener. For example, album art may be considered synchronized with associated audio if the onset of the images either leads or follows the onset of the audio by 3 seconds or less. For a karaoke implementation, for example, a word of karaoke text should not follow its associated time for singing that word but can be synchronized if it precedes the time for singing the word by as much as a few seconds (e.g., 1 to 3 seconds). In other embodiments, content may be deemed synchronized if it is rendered, for example, within about +/−3 seconds of associated audio, or within about +/−one-tenth of a second of associated audio.

Referring to the drawings, FIG. 1 is a functional block diagram of exemplary relevant components of a studio site 10, an FM transmitter site 12, and a studio transmitter link (STL) 14 that can be used to broadcast an FM IBOC digital radio broadcasting signal. The studio site includes, among other things, studio automation equipment 34, an Ensemble Operations Center (EOC) 16 that includes an importer 18, an exporter 20, and an exciter auxiliary service unit (EASU) 22. An STL transmitter 48 links the EOC with the transmitter site. The transmitter site includes an STL receiver 54, an exciter 56 that includes an exciter engine (exgine) subsystem 58, and an analog exciter 60. While in FIG. 1 the exporter is resident at a radio station's studio site and the exciter is located at the transmission site, these elements may be co-located at the transmission site.

At the studio site, the studio automation equipment supplies main program service (MPS) audio 42 to the EASU, MPS data 40 to the exporter, supplemental program service (SPS) audio 38 to the importer, and SPS data 36 to the importer 18. MPS audio serves as the main audio programming source. In hybrid modes, it preserves the existing analog radio programming formats in both the analog and digital transmissions. MPS data or SPS data, also known as program service data (PSD), includes information such as music title, artist, album name, etc. Supplemental program service can include supplementary audio content as well as program service data.

The importer 18 contains hardware and software for supplying advanced application services (AAS). AAS can include any type of data that is not classified as MPS, SPS, or Station Information Service (SIS). SIS provides station information, such as call sign, absolute time, position correlated to GPS, etc. Examples of AAS include data services for electronic program guides, navigation maps, real-time traffic and weather information, multimedia applications, other audio services, and other data content. The content for AAS can be supplied by service providers 44, which provide service data 46 to the importer via an application program interface (API). The service providers may be a broadcaster located at the studio site or externally sourced third-party providers of services and content. The importer can establish session connections between multiple service providers. The importer encodes and multiplexes service data 46, SPS audio 38, and SPS data 36 to produce exporter link data 24, which is output to the exporter via a data link. The importer 18 also encodes a SIG, in which it typically identifies and describes available services. For example, the SIG may include data identifying the genre of the services available on the current frequency (e.g., the genre of MPS audio and any SPS audio).

The importer 18 can use a data transport mechanism, which may be referred to herein as a radio link subsystem (RLS), to provide packet encapsulation, varying levels of quality of service (e.g., varying degrees of forward error correction and interleaving), and bandwidth management functions. The RLS uses High-Level Data Link Control (HDLC) type framing for encapsulating the packets. HDLC is known to one of skill in the art and is described in ISO/IEC 13239:2002 Information technology—Telecommunications and information exchange between systems—High-level data link control (HDLC) procedures. HDLC framing includes a beginning frame delimiter (e.g., '0x7E') and an ending frame delimiter (e.g., '0x7E'). The RLS header includes a logical address (e.g., port number), a control field for sequence numbers and other information (e.g., packet 1 of 2, 2 of 2 etc.), the payload (e.g., the index file), and a checksum (e.g., a CRC). For bandwidth management, the importer 18 typically assigns logical addresses (e.g. ports) to AAS data based on, for example, the number and type of services being configured at any given studio site 10. RLS is described in more detail in U.S. Pat. No. 7,305,043, which is incorporated herein by reference in its entirety.

Due to receiver implementation choices, RLS packets can be limited in size to about 8192 bytes, but other sizes could be used. Therefore data may be prepared for transmission according to two primary data segmentation modes—packet mode and byte-streaming mode—for transmitting objects larger than the maximum packet size. In packet mode the importer 18 may include a large object transfer (LOT) client (e.g. a software client that executes on the same computer processing system as the importer 18 or on a different processing system such as a remote processing system) to segment a "large" object (for example, a sizeable image file) into fragments no larger than the chosen RLS packet size. In typical embodiments objects may range in size up to 4,294,967,295 bytes. At the transmitter, the LOT client writes packets to an RLS port for broadcast to the receiver. At the receiver, the LOT client reads packets from the RLS port of the same number. The LOT client may process data associated with many RLS ports (e.g., typically up to 32 ports) simultaneously, both at the receiver and the transmitter.

The LOT client operates by sending a large object in several messages, each of which is no longer than the maximum packet size. To accomplish this, the transmitter assigns an integer called a LotID to each object broadcast via the LOT protocol. All messages for the same object will use the same LotID. The choice of LotID is arbitrary except that no two objects being broadcast concurrently on the same RLS port may have the same LotID. In some implementations, it may be advantageous to exhaust all possible LotID values before a value is reused.

When transmitting data over-the-air, there may be some packet loss due to the probabilistic nature of the radio propagation environment. The LOT client addresses this issue by allowing the transmitter to repeat the transmission of an entire object. Once an object has been received correctly, the receiver can ignore any remaining repetitions. All repetitions will use the same LotID. Additionally, the transmitter may interleave messages for different objects on the same RLS port so long as each object on the port has been assigned a unique LotID.

The LOT client divides a large object into messages, which are further subdivided into fragments. Preferably all the fragments in a message, excepting the last fragment, are a fixed length such as 256 bytes. The last fragment may be any length that is less than the fixed length (e.g., less than 256 bytes). Fragments are numbered consecutively starting from zero. However, in some embodiments an object may have a zero-length object—the messages would contain only descriptive information about the object.

The LOT client typically uses two types of messages—a full header message, and a fragment header message. Each message includes a header followed by fragments of the object. The full header message contains the information to reassemble the object from the fragments plus descriptive information about the object. By comparison, the fragment header message contains only the reassembly information. The LOT client of the receiver (e.g. a software and/or hardware application that typically executes within the data processors 232 and 288 of FIGS. 7 and 8 respectively or any other suitable processing system) distinguishes between the two types of messages by a header-length field (e.g. field name "hdrLen"). Each message can contain any suitable number of fragments of the object identified by the LotID in the header as long as the maximum RLS packet length is not exceeded. There is no requirement that all messages for an object contain the same number of fragments. Table 1 below illustrates exemplary field names and their corresponding descriptions for a full header message. Fragment header messages typically include only the hdrLen, repeat, LotID, and position fields.

TABLE 1

| FIELD NAME | FIELD DESCRIPTION |
|---|---|
| hdrLen | Size of the header in bytes, including the hdrLen field. Typically ranges from 24-255 bytes. |
| Repeat | Number of object repetitions remaining. Typically ranges from 0 to 255. All messages for the same repetition of the object use the same repeat value. When repeating an object, the transmitter broadcasts all messages having repeat = R before broadcasting any messages having repeat = R-1. A value of 0 typically means the object will not be repeated again. |
| LotID | Arbitrary identifier assigned by the transmitter to the object. Typically range from 0 to 65,535. All messages for the same object use the same LotID value. |
| Position | The byte offset in the reassembled object of the first fragment in the message equals 256*position. Equivalent to "fragment number". |
| Version | Version of the LOT protocol |
| discardTime | Year, month, day, hour, and minute after which the object may be discarded at the receiver. Expressed in Coordinated Universal Time (UTC). |
| fileSize | Total size of the object in bytes. |
| mime Hash | MIME hash describing the type of object |
| Filename | Fie name associated with the object |

Full header and fragment header messages may be sent in any ratio provided that at least one full header message is broadcast for each object. Bandwidth efficiency will typically be increased by minimizing the number of full header messages; however, this may increase the time necessary for the receiver to determine whether an object is of interest based on the descriptive information that is only present in the full header. Therefore there is typically a trade between efficient use of broadcast bandwidth and efficient receiver processing and reception of desired LOT files.

In byte-streaming mode, as in packet mode, each data service is allocated a specific bandwidth by the radio station operators based on the limits of the digital radio broadcast modem frames. The importer 18 then receives data messages of arbitrary size from the data services. The data bytes received from each service are then placed in a byte bucket (e.g. a queue) and HDLC frames are constructed based on the bandwidth allocated to each service. For example, each service may have its own HDLC frame that will be just the right size to fit into a modem frame. For example, assume that there are two data services, service #1 and service #2. Service #1 has been allocated 1024 bytes, and service #2 512 bytes. Now assume that service #1 sends message A having 2048 bytes, and service #2 sends message B also having 2048 bytes. Thus the first modem frame will contain two HDLC frames; a 1024 byte frame containing N bytes of message A and a 512 byte HDLC frame containing M bytes of message B. N & M are determined by how many HDLC escape characters are needed and the size of the RLS header information. If no escape characters are needed then N=1015 and M=503 assuming a 9 byte RLS header. If the messages contain nothing but HDLC framing bytes (i.e. 0x7E) then N=503 and M=247, again assuming a 9 byte RLS header containing no escape characters. Also, if data service #1 does not send a new message (call it message AA) then its unused bandwidth may be given to service #2 so its HDLC frame will be larger than its allocated bandwidth of 512 bytes.

The exporter 20 contains the hardware and software necessary to supply the main program service and SIS for broadcasting. The exporter accepts digital MPS audio 26 over an audio interface and compresses the audio. The exporter also multiplexes MPS data 40, exporter link data 24, and the compressed digital MPS audio to produce exciter link data 52. In addition, the exporter accepts analog MPS audio 28 over its audio interface and applies a pre-programmed delay to it to produce a delayed analog MPS audio signal 30. This analog audio can be broadcast as a backup channel for hybrid IBOC digital radio broadcasts. The delay compensates for the system delay of the digital MPS audio, allowing receivers to blend between the digital and analog program without a shift in time. In an AM transmission system, the delayed MPS audio signal 30 is converted by the exporter to a mono signal and sent directly to the STL as part of the exciter link data 52.

The EASU 22 accepts MPS audio 42 from the studio automation equipment, rate converts it to the proper system clock, and outputs two copies of the signal, one digital (26) and one analog (28). The EASU includes a GPS receiver that is connected to an antenna 25. The GPS receiver allows the EASU to derive a master clock signal, which is synchronized to the exciter's clock by use of GPS units. The EASU provides the master system clock used by the exporter. The EASU is also used to bypass (or redirect) the analog MPS audio from being passed through the exporter in the event the exporter has a catastrophic fault and is no longer operational. The bypassed audio 32 can be fed directly into the STL transmitter, eliminating a dead-air event.

STL transmitter 48 receives delayed analog MPS audio 50 and exciter link data 52. It outputs exciter link data and delayed analog MPS audio over STL link 14, which may be either unidirectional or bidirectional. The STL link may be a digital microwave or Ethernet link, for example, and may use the standard User Datagram Protocol or the standard TCP/IP.

The transmitter site includes an STL receiver 54, an exciter engine (exgine) 56 and an analog exciter 60. The STL receiver 54 receives exciter link data, including audio and data signals as well as command and control messages, over the STL link 14. The exciter link data is passed to the exciter 56, which produces the IBOC digital radio broadcasting waveform. The exciter includes a host processor, digital up-converter, RF up-converter, and exgine subsystem 58. The exgine accepts exciter link data and modulates the digital portion of the IBOC digital radio broadcasting waveform. The digital up-converter of exciter 56 converts from digital-to-analog the baseband portion of the exgine output. The digital-to-analog conversion is based on a GPS clock, common to that of the exporter's GPS-based clock derived from the EASU. Thus, the exciter 56 includes a GPS unit and antenna 57. An alternative method for synchronizing the exporter and exciter clocks can be found in U.S. Pat. No. 7,512,175, the disclosure of which is hereby incorporated by reference. The RF up-converter of the exciter up-converts the analog signal to the proper in-band channel frequency. The up-converted signal is then passed to the high power amplifier 62 and antenna 64 for broadcast. In an AM transmission system, the exgine subsystem coherently adds the backup analog MPS audio to the digital waveform in the hybrid mode; thus, the AM transmission system does not include the analog exciter 60. In addition, in an AM transmission system, the exciter 56 produces phase and magnitude information and the analog signal is output directly to the high power amplifier.

IBOC digital radio broadcasting signals can be transmitted in both AM and FM radio bands, using a variety of waveforms. The waveforms include an FM hybrid IBOC digital radio broadcasting waveform, an FM all-digital IBOC digital radio broadcasting waveform, an AM hybrid IBOC digital radio broadcasting waveform, and an AM all-digital IBOC digital radio broadcasting waveform.

Figure 2:
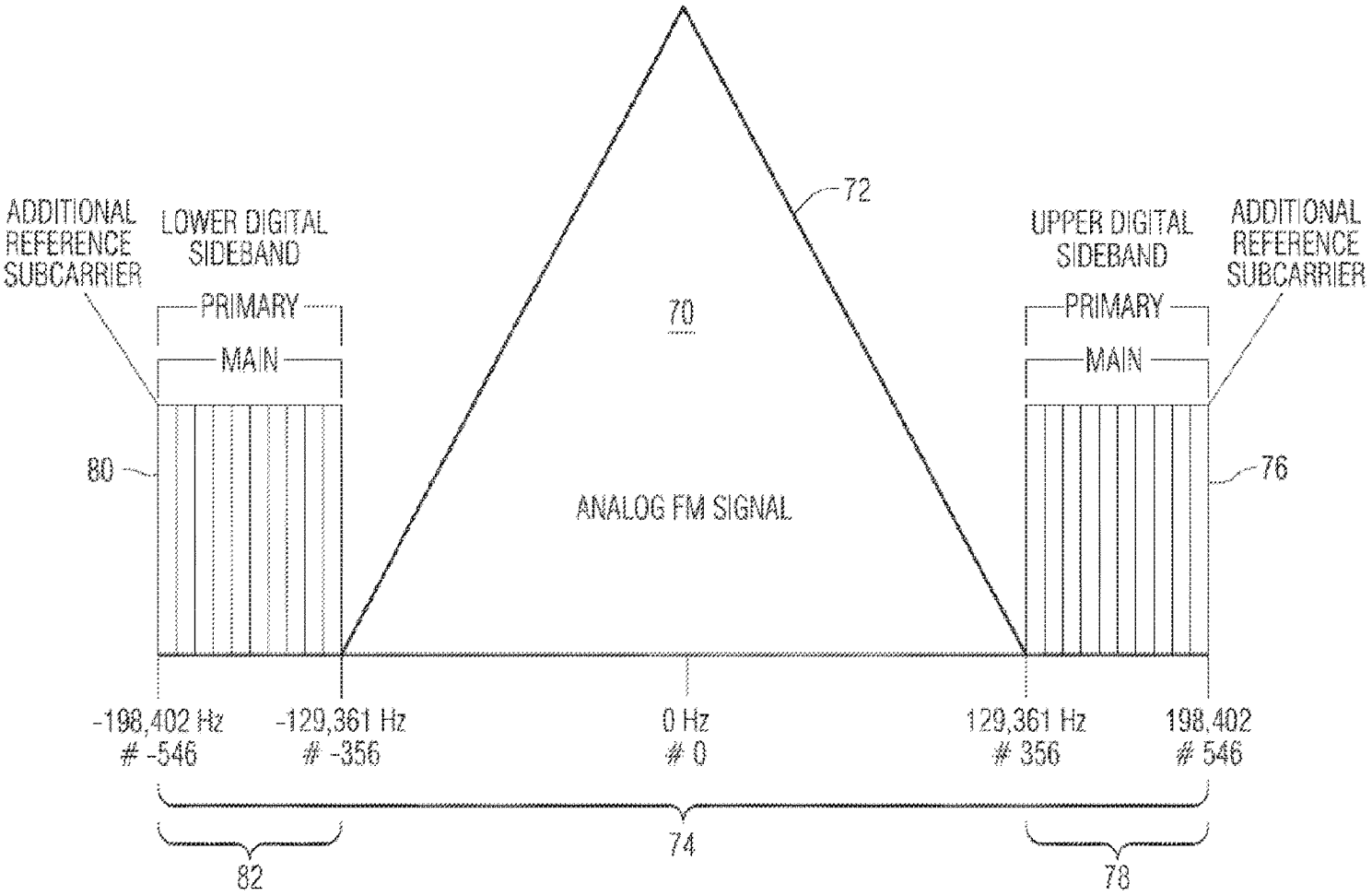
FIG. 2 is a schematic representation of a hybrid FM IBOC waveform.

FIG. 2 is a schematic representation of a hybrid FM IBOC waveform 70. The waveform includes an analog modulated signal 72 located in the center of a broadcast channel 74, a first plurality of evenly spaced orthogonally frequency division multiplexed subcarriers 76 in an upper sideband 78, and a second plurality of evenly spaced orthogonally frequency division multiplexed subcarriers 80 in a lower sideband 82. The digitally modulated subcarriers are divided into partitions and various subcarriers are designated as reference subcarriers. A frequency partition is a group of 19 OFDM subcarriers containing 18 data subcarriers and one reference subcarrier.

The hybrid waveform includes an analog FM-modulated signal, plus digitally modulated primary main subcarriers. The subcarriers are located at evenly spaced frequency locations. The subcarrier locations are numbered from −546 to +546. In the waveform of FIG. 2, the subcarriers are at locations +356 to +546 and −356 to −546. Each primary main sideband is comprised of ten frequency partitions. Subcarriers 546 and −546, also included in the primary main sidebands, are additional reference subcarriers. The amplitude of each subcarrier can be scaled by an amplitude scale factor.

Figure 3:
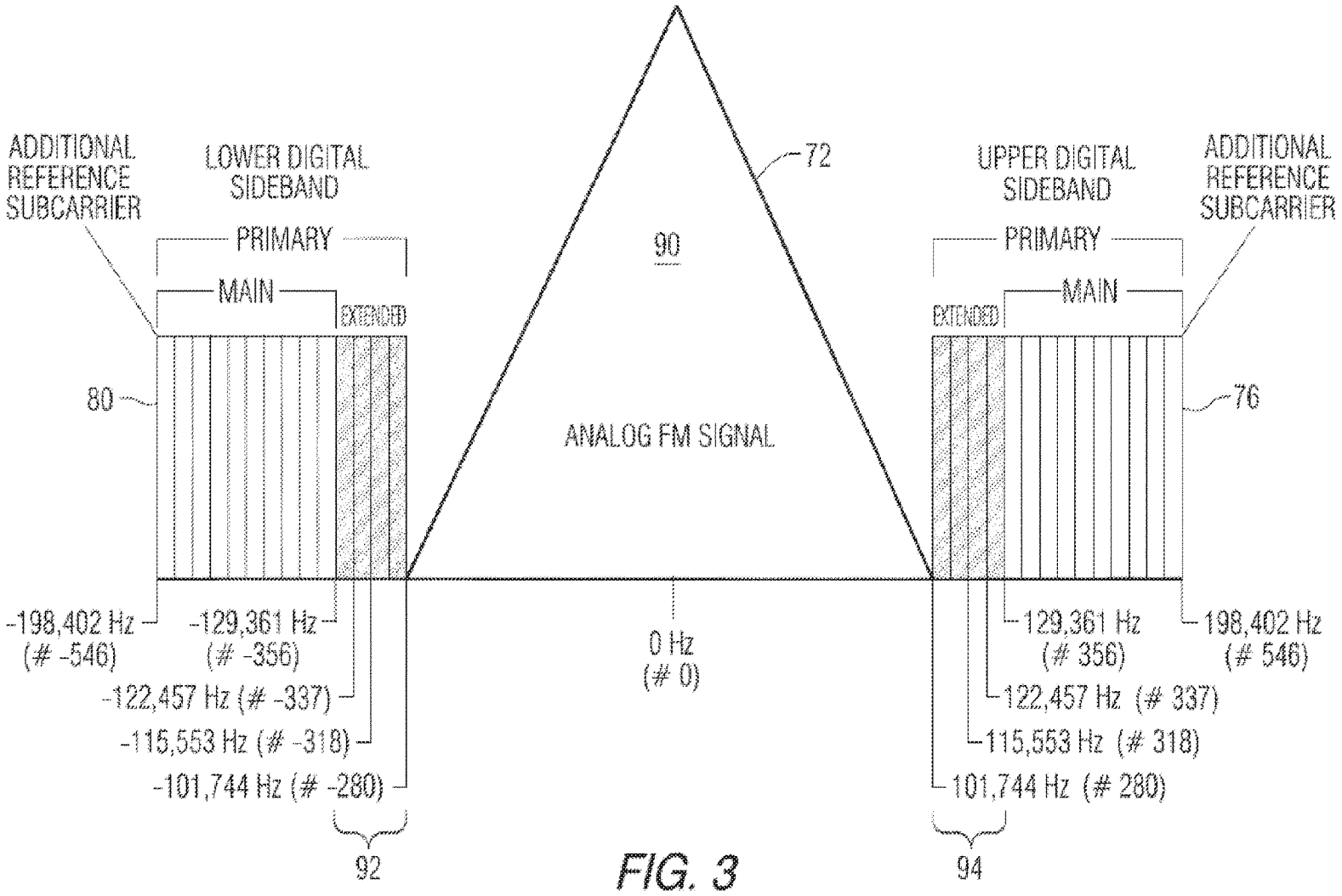
FIG. 3 is a schematic representation of an extended hybrid FM IBOC waveform.

FIG. 3 is a schematic representation of an extended hybrid FM IBOC waveform 90. The extended hybrid waveform is created by adding primary extended sidebands 92, 94 to the primary main sidebands present in the hybrid waveform. One, two, or four frequency partitions can be added to the inner edge of each primary main sideband. The extended hybrid waveform includes the analog FM signal plus digitally modulated primary main subcarriers (subcarriers +356 to +546 and −356 to −546) and some or all primary extended subcarriers (subcarriers +280 to +355 and −280 to −355).

The upper primary extended sidebands include subcarriers 337 through 355 (one frequency partition), 318 through 355 (two frequency partitions), or 280 through 355 (four frequency partitions). The lower primary extended sidebands include subcarriers −337 through −355 (one frequency partition), −318 through −355 (two frequency partitions), or −280 through −355 (four frequency partitions). The amplitude of each subcarrier can be scaled by an amplitude scale factor.

Figure 4:
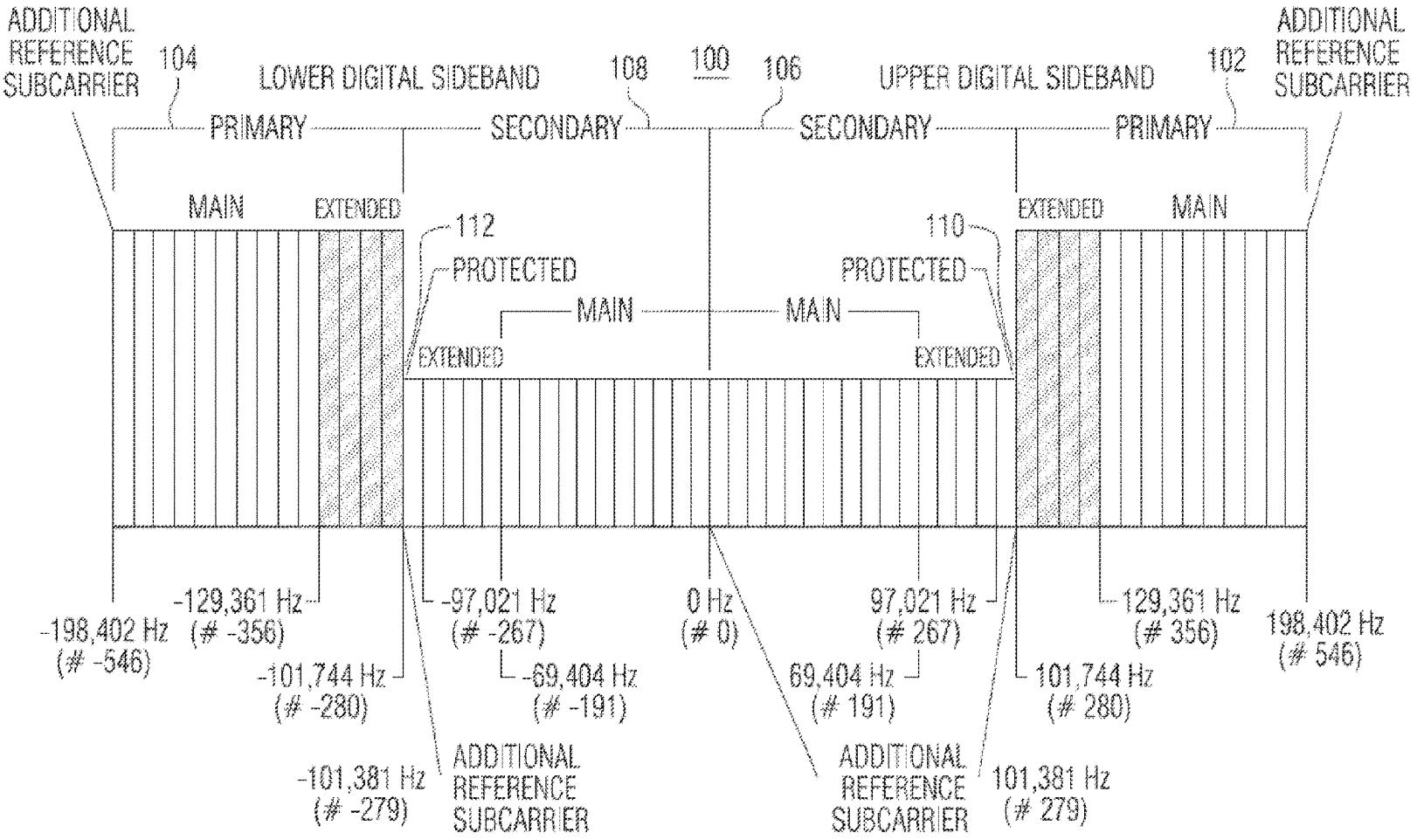
FIG. 4 is a schematic representation of an all-digital FM IBOC waveform.

FIG. 4 is a schematic representation of an all-digital FM IBOC waveform 100. The all-digital waveform is constructed by disabling the analog signal, fully extending the bandwidth of the primary digital sidebands 102, 104, and adding lower-power secondary sidebands 106, 108 in the spectrum vacated by the analog signal. The all-digital waveform in the illustrated embodiment includes digitally modulated subcarriers at subcarrier locations −546 to +546, without an analog FM signal.

In addition to the ten main frequency partitions, all four extended frequency partitions are present in each primary sideband of the all-digital waveform. Each secondary sideband also has ten secondary main (SM) and four secondary extended (SX) frequency partitions. Unlike the primary sidebands, however, the secondary main frequency partitions are mapped nearer to the channel center with the extended frequency partitions farther from the center.

Each secondary sideband also supports a small secondary protected (SP) region 110, 112 including 12 OFDM subcarriers and reference subcarriers 279 and −279. The sidebands are referred to as "protected" because they are located in the area of spectrum least likely to be affected by analog or digital interference. An additional reference subcarrier is placed at the center of the channel (0). Frequency partition ordering of the SP region does not apply since the SP region does not contain frequency partitions.

Each secondary main sideband spans subcarriers 1 through 190 or −1 through −190. The upper secondary extended sideband includes subcarriers 191 through 266, and the upper secondary protected sideband includes subcarriers 267 through 278, plus additional reference subcarrier 279. The lower secondary extended sideband includes subcarriers −191 through −266, and the lower secondary protected sideband includes subcarriers −267 through −278, plus additional reference subcarrier −279. The total frequency span of the entire all-digital spectrum is 396,803 Hz. The amplitude of each subcarrier can be scaled by an amplitude scale factor. The secondary sideband amplitude scale factors can be user selectable. Any one of the four may be selected for application to the secondary sidebands.

In each of the waveforms, the digital signal is modulated using orthogonal frequency division multiplexing (OFDM). OFDM is a parallel modulation scheme in which the data stream modulates a large number of orthogonal subcarriers, which are transmitted simultaneously. OFDM is inherently flexible, readily allowing the mapping of logical channels to different groups of subcarriers.

In the hybrid waveform, the digital signal is transmitted in primary main (PM) sidebands on either side of the analog FM signal in the hybrid waveform. The power level of each sideband is appreciably below the total power in the analog FM signal. The analog signal may be monophonic or stereophonic, and may include subsidiary communications authorization (SCA) channels.

In the extended hybrid waveform, the bandwidth of the hybrid sidebands can be extended toward the analog FM signal to increase digital capacity. This additional spectrum, allocated to the inner edge of each primary main sideband, is termed the primary extended (PX) sideband.

In the all-digital waveform, the analog signal is removed and the bandwidth of the primary digital sidebands is fully extended as in the extended hybrid waveform. In addition, this waveform allows lower-power digital secondary sidebands to be transmitted in the spectrum vacated by the analog FM signal.

Figure 5:
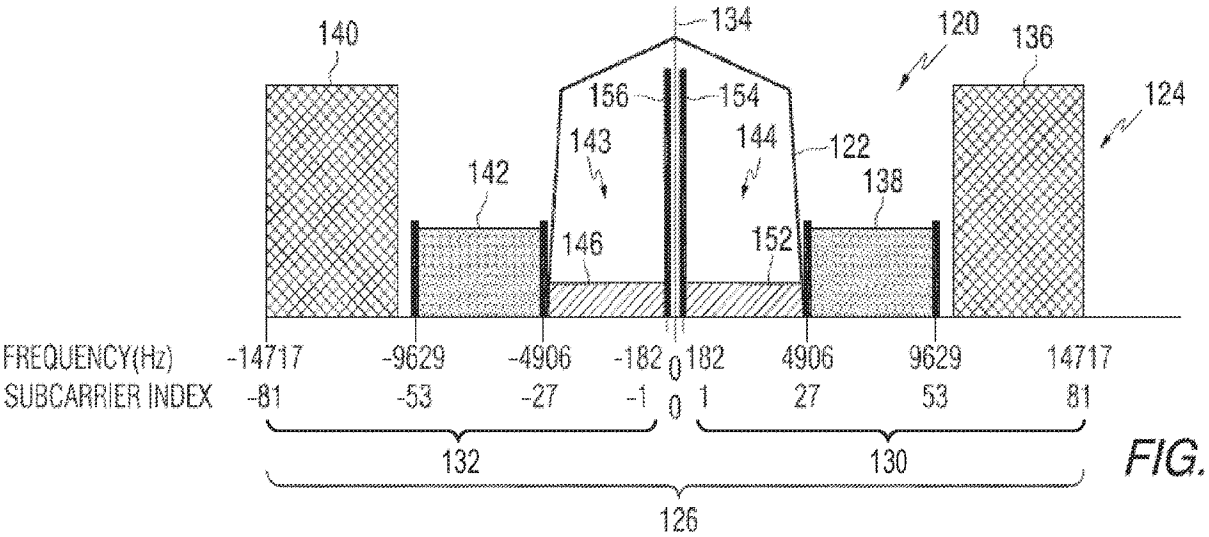
FIG. 5 is a schematic representation of a hybrid AM IBOC waveform.

FIG. 5 is a schematic representation of an AM hybrid IBOC digital radio broadcasting waveform 120. The hybrid format includes the conventional AM analog signal 122 (bandlimited to about ±5 kHz) along with a nearly 30 kHz wide digital radio broadcasting signal 124. The spectrum is contained within a channel 126 having a bandwidth of about 30 kHz. The channel is divided into upper 130 and lower 132 frequency bands. The upper band extends from the center frequency of the channel to about +15 kHz from the center frequency. The lower band extends from the center frequency to about −15 kHz from the center frequency.

The AM hybrid IBOC digital radio broadcasting signal format in one example comprises the analog modulated carrier signal 134 plus OFDM subcarrier locations spanning the upper and lower bands. Coded digital information representative of the audio or data signals to be transmitted (program material), is transmitted on the subcarriers. The symbol rate is less than the subcarrier spacing due to a guard time between symbols.

As shown in FIG. 5, the upper band is divided into a primary section 136, a secondary section 138, and a tertiary section 144. The lower band is divided into a primary section 140, a secondary section 142, and a tertiary section 143. For the purpose of this explanation, the tertiary sections 143 and 144 can be considered to include a plurality of groups of subcarriers labeled 146 and 152 in FIG. 5. Subcarriers within the tertiary sections that are positioned near the center of the channel are referred to as inner subcarriers, and subcarriers within the tertiary sections that are positioned farther from the center of the channel are referred to as outer subcarriers. The groups of subcarriers 146 and 152 in the tertiary sections have substantially constant power levels. FIG. 5 also shows two reference subcarriers 154 and 156 for system control, whose levels are fixed at a value that is different from the other sidebands.

The power of subcarriers in the digital sidebands is significantly below the total power in the analog AM signal. The level of each OFDM subcarrier within a given primary or secondary section is fixed at a constant value. Primary or secondary sections may be scaled relative to each other. In addition, status and control information is transmitted on reference subcarriers located on either side of the main carrier. A separate logical channel, such as an IBOC Data Service (IDS) channel can be transmitted in individual subcarriers just above and below the frequency edges of the upper and lower secondary sidebands. The power level of each primary OFDM subcarrier is fixed relative to the unmodulated main analog carrier. However, the power level of the secondary subcarriers, logical channel subcarriers, and tertiary subcarriers is adjustable.

Using the modulation format of FIG. 5, the analog modulated carrier and the digitally modulated subcarriers are transmitted within the channel mask specified for standard AM broadcasting in the United States. The hybrid system uses the analog AM signal for tuning and backup.

Figure 6:
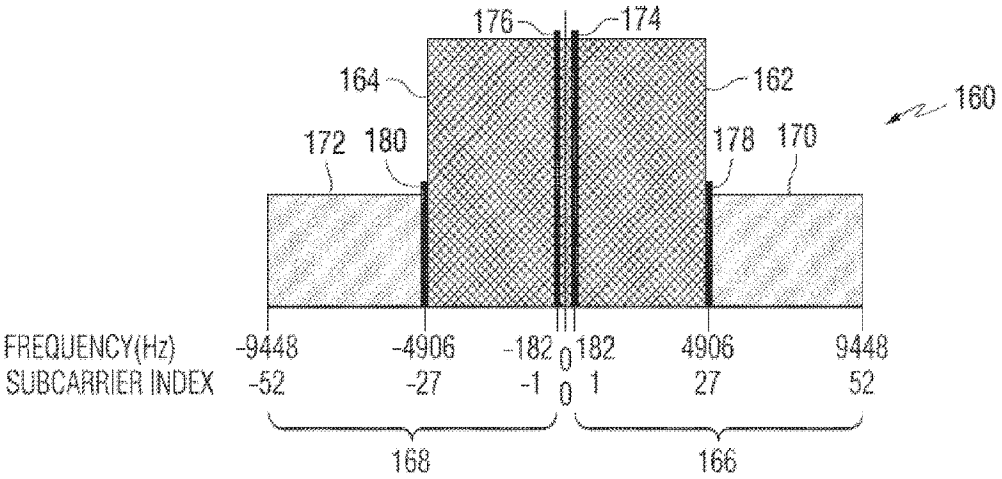
FIG. 6 is a schematic representation of an all-digital AM IBOC waveform.

FIG. 6 is a schematic representation of the subcarrier assignments for an all-digital AM IBOC digital radio broadcasting waveform. The all-digital AM IBOC digital radio broadcasting signal 160 includes first and second groups 162 and 164 of evenly spaced subcarriers, referred to as the primary subcarriers, that are positioned in upper and lower bands 166 and 168. Third and fourth groups 170 and 172 of subcarriers, referred to as secondary and tertiary subcarriers respectively, are also positioned in upper and lower bands 166 and 168. Two reference subcarriers 174 and 176 of the third group lie closest to the center of the channel. Subcarriers 178 and 180 can be used to transmit program information data.

Figure 7:
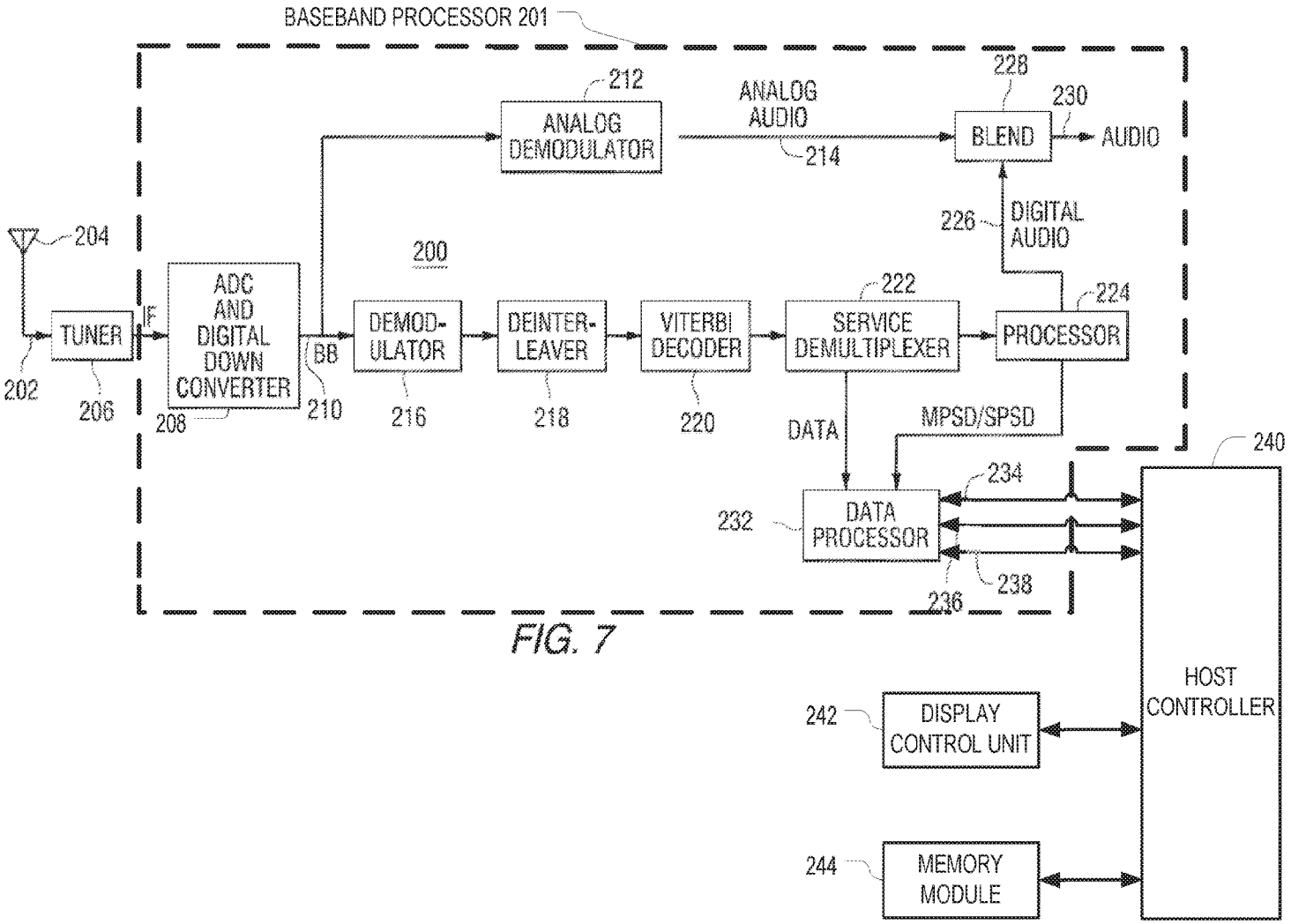
FIG. 7 is a functional block diagram of an AM IBOC digital radio broadcasting receiver in accordance with certain embodiments.

FIG. 7 is a simplified functional block diagram of the relevant components of an exemplary AM IBOC digital radio broadcasting receiver 200. While only certain components of the receiver 200 are shown for exemplary purposes, it should be apparent that the receiver may comprise a number of additional components and may be distributed among a number of separate enclosures having tuners and front-ends, speakers, remote controls, various input/output devices, etc. The receiver 200 has a tuner 206 that includes an input 202 connected to an antenna 204. The receiver also includes a baseband processor 201 that includes a digital down converter 208 for producing a baseband signal on line 210. An analog demodulator 212 demodulates the analog modulated portion of the baseband signal to produce an analog audio signal on line 214. A digital demodulator 216 demodulates the digitally modulated portion of the baseband signal. Then the digital signal is deinterleaved by a deinterleaver 218, and decoded by a Viterbi decoder 220. A service demultiplexer 222 separates main and supplemental program signals from data signals. A processor 224 processes the program signals to produce a digital audio signal on line 226. The analog and main digital audio signals are blended as shown in block 228, or a supplemental digital audio signal is passed through, to produce an audio output on line 230. A data processor 232 processes the data signals and produces data output signals on lines 234, 236 and 238. The data lines 234, 236, and 238 may be multiplexed together onto a suitable bus such as an inter-integrated circuit ($I^2C$), serial peripheral interface (SPI), universal asynchronous receiver/transmitter (UART), or universal serial bus (USB). The data signals can include, for example, SIS, MPS data, SPS data, and one or more AAS.

The host controller 240 receives and processes the data signals (e.g., the SIS, MPSD, SPSD, and AAS signals). The host controller 240 comprises a microcontroller that is coupled to the display control unit (DCU) 242 and memory module 244. Any suitable microcontroller could be used such as an Atmel® AVR 8-bit reduced instruction set computer (RISC) microcontroller, an advanced RISC machine (ARM®) 32-bit microcontroller or any other suitable microcontroller. Additionally, a portion or all of the functions of the host controller 240 could be performed in a baseband processor (e.g., the processor 224 and/or data processor 232). The DCU 242 comprises any suitable I/O processor that controls the display, which may be any suitable visual display such as an LCD or LED display. In certain embodiments, the DCU 242 may also control user input components via touch-screen display. In certain embodiments the host controller 240 may also control user input from a keyboard, dials, knobs or other suitable inputs. The memory module 244 may include any suitable data storage medium such as RAM, Flash ROM (e.g., an SD memory card), and/or a hard disk drive. In certain embodiments, the memory module 244 may be included in an external component that communicates with the host controller 240 such as a remote control.

Figure 8:
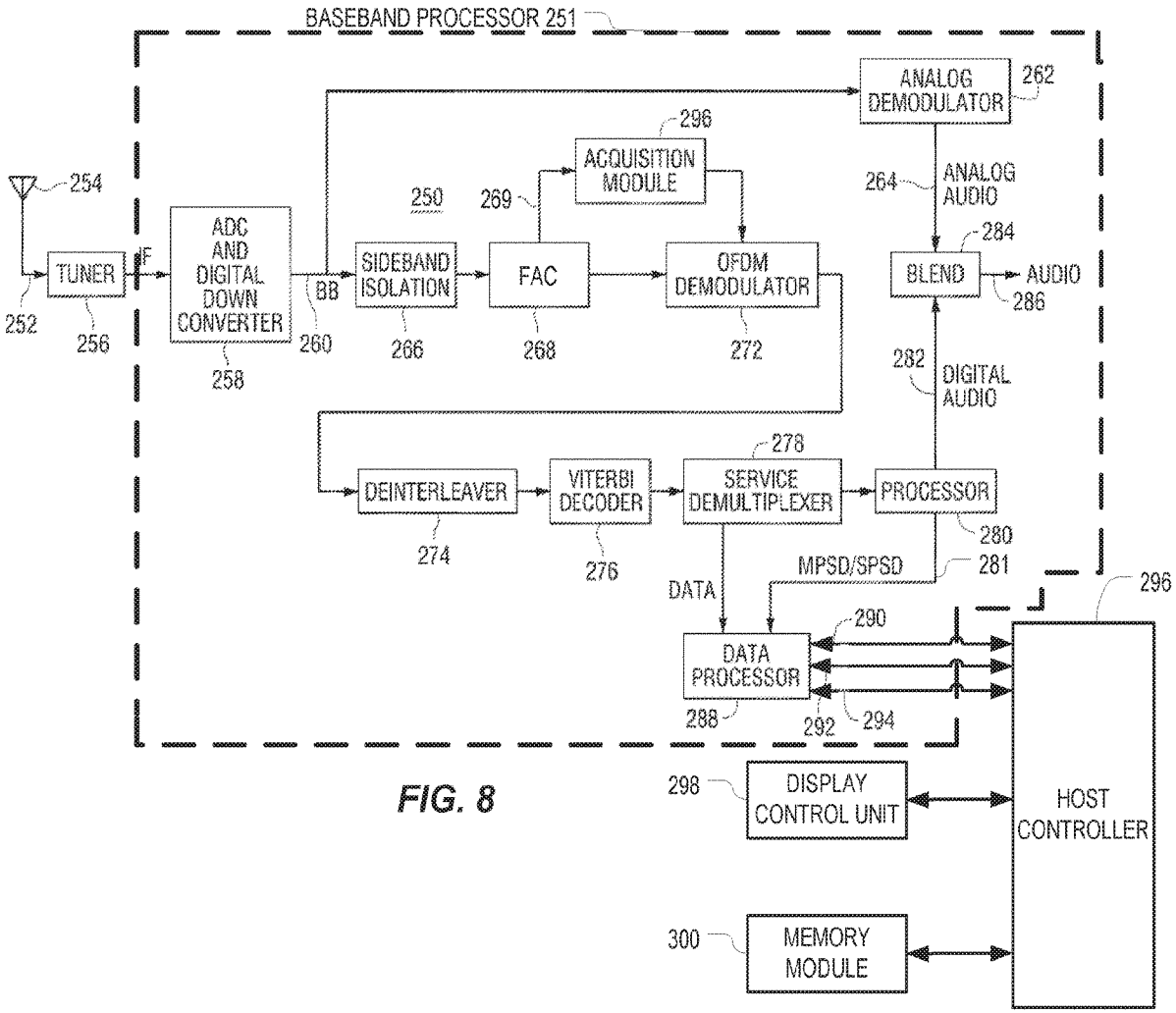
FIG. 8 is a functional block diagram of an FM IBOC digital radio broadcasting receiver in accordance with certain embodiments.

FIG. 8 is a simplified functional block diagram of the relevant components of an exemplary FM IBOC digital radio broadcasting receiver 250. While only certain components of the receiver 250 are shown for exemplary purposes, it should be apparent that the receiver may comprise a number of additional components and may be distributed among a number of separate enclosures having tuners and front-ends, speakers, remote controls, various input/output devices, etc. The exemplary receiver includes a tuner 256 that has an input 252 connected to an antenna 254. The receiver also includes a baseband processor 251. The IF signal from the tuner 256 is provided to an analog-to-digital converter and digital down converter 258 to produce a baseband signal at output 260 comprising a series of complex signal samples. The signal samples are complex in that each sample comprises a "real" component and an "imaginary" component. An analog demodulator 262 demodulates the analog modulated portion of the baseband signal to produce an analog audio signal on line 264. The digitally modulated portion of the sampled baseband signal is next filtered by isolation filter 266, which has a pass-band frequency response comprising the collective set of subcarriers $f_1$-$f_n$ present in the received OFDM signal. First adjacent canceller (FAC) 268 suppresses the effects of a first-adjacent interferer. Complex signal 269 is routed to the input of acquisition module 296, which acquires or recovers OFDM symbol timing offset or error and carrier frequency offset or error from the received OFDM symbols as represented in received complex signal 298. Acquisition module 296 develops a symbol timing offset $\Delta t$ and carrier frequency offset $\Delta f$, as well as status and control information. The signal is then demodulated (block 272) to demodulate the digitally modulated portion of the baseband signal. Then the digital signal is deinterleaved by a deinterleaver 274, and decoded by a Viterbi decoder 276. A service demultiplexer 278 separates main and supplemental program signals from data signals. A processor 280 processes the main and supplemental program signals to produce a digital audio signal on line 282 and MPSD/SPSD 281. The analog and main digital audio signals are blended as shown in block 284, or the supplemental program signal is passed through, to produce an audio output on line 286. A data processor 288 processes the data signals and produces data output signals on lines 290, 292 and 294. The data lines 290, 292 and 294 may be multiplexed together onto a suitable bus such as an $I^2C$, SPI, UART, or USB. The data signals can include, for example, SIS, MPS data, SPS data, and one or more AAS.

The host controller 296 receives and processes the data signals (e.g., SIS, MPS data, SPS data, and AAS). The host controller 296 comprises a microcontroller that is coupled to the DCU 298 and memory module 300. Any suitable microcontroller could be used such as an Atmel® AVR 8-bit RISC microcontroller, an advanced RISC machine (ARM®) 32-bit microcontroller or any other suitable microcontroller. Additionally, a portion or all of the functions of the host controller 296 could be performed in a baseband processor (e.g., the processor 280 and/or data processor 288). The DCU 298 comprises any suitable I/O processor that controls the display, which may be any suitable visual display such as an LCD or LED display. In certain embodiments, the DCU 298 may also control user input components via a touch-screen display. In certain embodiments the host controller 296 may also control user input from a keyboard, dials, knobs or other suitable inputs. The memory module 300 may include any suitable data storage medium such as RAM, Flash ROM (e.g., an SD memory card), and/or a hard disk drive. In certain embodiments, the memory module 300 may be included in an external component that communicates with the host controller 296 such as a remote control.

In practice, many of the signal processing functions shown in the receivers of FIGS. 7 and 8 can be implemented using one or more integrated circuits. For example, while in FIGS. 7 and 8 the signal processing block, host controller, DCU, and memory module are shown as separate components, the functions of two or more of these components could be combined in a single processor (e.g., a System on a Chip (SoC)).

Figure 9A:
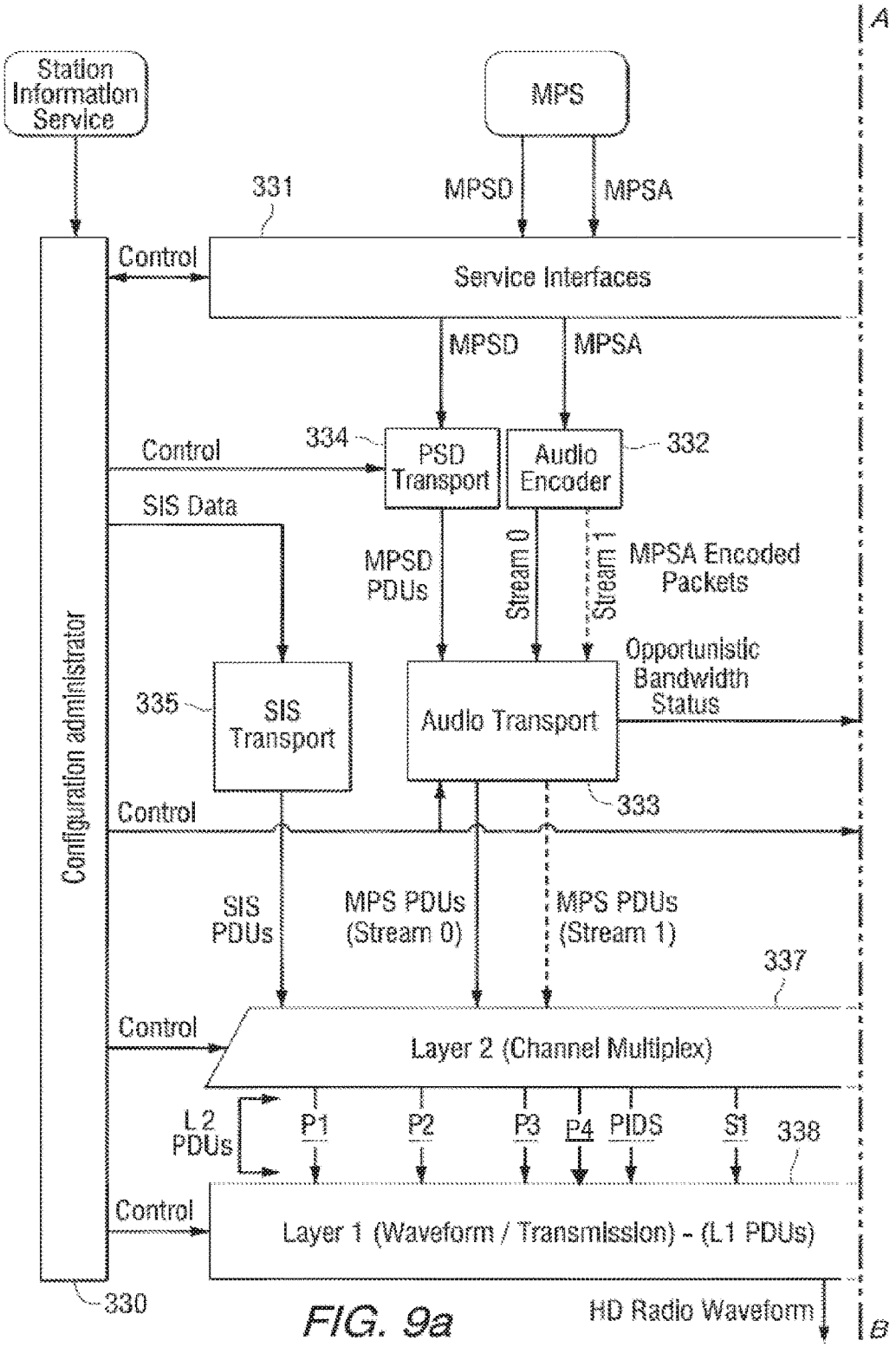
FIGS. 9*a* and 9*b* are diagrams of an IBOC digital radio broadcasting logical protocol stack from the broadcast perspective.
Figure 9B:
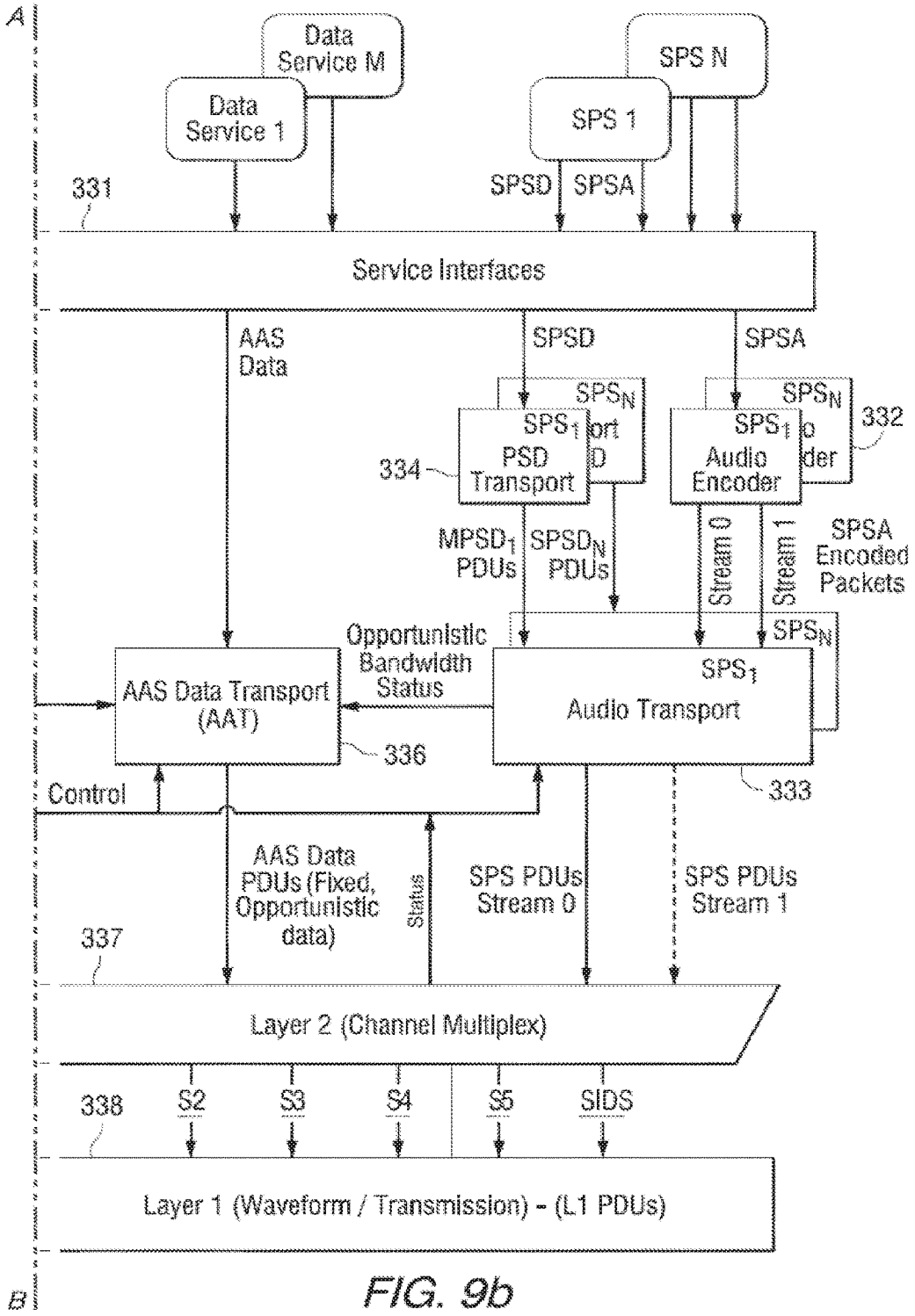

FIGS. 9*a* and 9*b* are diagrams of an IBOC digital radio broadcasting logical protocol stack from the transmitter perspective. From the receiver perspective, the logical stack will be traversed in the opposite direction. Most of the data being passed between the various entities within the protocol stack are in the form of protocol data units (PDUs). A PDU is a structured data block that is produced by a specific layer (or process within a layer) of the protocol stack. The PDUs of a given layer may encapsulate PDUs from the next higher layer of the stack and/or include content data and protocol control information originating in the layer (or process) itself. The PDUs generated by each layer (or process) in the transmitter protocol stack are inputs to a corresponding layer (or process) in the receiver protocol stack.

As shown in FIGS. 9*a* and 9*b*, there is a configuration administrator 330, which is a system function that supplies configuration and control information to the various entities within the protocol stack. The configuration/control information can include user defined settings, as well as information generated from within the system such as GPS time and position. The service interfaces 331 represent the interfaces for all services. The service interface may be different for each of the various types of services. For example, for MPS audio and SPS audio, the service interface may be an audio card. For MPS data and SPS data the interfaces may be in the form of different APIs. For all other data services the interface is in the form of a single API. An audio encoder 332 encodes both MPS audio and SPS audio to produce core (Stream 0) and optional enhancement (Stream 1) streams of MPS and SPS audio encoded packets, which are passed to audio transport 333. Audio encoder 332 also relays unused capacity status to other parts of the system, thus allowing the inclusion of opportunistic data. MPS and SPS data is processed by PSD transport 334 to produce MPS and SPS data PDUs, which are passed to audio transport 333. Audio transport 333 receives encoded audio packets and PSD PDUs and outputs bit streams containing both compressed audio and program service data. The SIS transport 335 receives SIS data from the configuration administrator and generates SIS PDUs. A SIS PDU can contain station identification and location information, indications regarding provided audio and data services, as well as absolute time and position correlated to GPS, as well as other information conveyed by the station. The AAS data transport 336 receives AAS data from the service interface, as well as opportunistic bandwidth data from the audio transport, and generates AAS data PDUs, which can be based on quality of service parameters. The transport and encoding functions are collectively referred to as Layer 4 of the protocol stack and the corresponding transport PDUs are referred to as Layer 4 PDUs or L4 PDUs. Layer 2, which is the channel multiplex layer, (337) receives transport PDUs from the SIS transport, AAS data transport, and audio transport, and formats them into Layer 2 PDUs. A Layer 2 PDU includes protocol control information and a payload, which can be audio, data, or a combination of audio and data. Layer 2 PDUs are routed through the correct logical channels to Layer 1 (338), wherein a logical channel is a signal path that conducts L1 PDUs through Layer 1 with a specified grade of service, and possibly mapped into a predefined collection of subcarriers.

Layer 1 data in an IBOC system can be considered to be temporally divided into frames (e.g., modem frames). In typical embodiments, each modem frame has a frame duration ($T_f$) of approximately 1.486 seconds. Each modem frame includes an absolute layer 1 frame number (ALFN) in the SIS, which is a sequential number assigned to every Layer 1 frame. This ALFN corresponds to the broadcast starting time of a modem frame. The start time of ALFN 0 was 00:00:00 Universal Coordinated Time (UTC) on Jan. 6, 1980 and each subsequent ALFN is incremented by one from the previous ALFN. Thus the present time can be calculated by multiplying the next frame's ALFN with $T_f$ and adding the total to the start time of ALFN 0.

There are multiple Layer 1 logical channels based on service mode, wherein a service mode is a specific configuration of operating parameters specifying throughput, performance level, and selected logical channels. The number of active Layer 1 logical channels and the characteristics defining them vary for each service mode. Status information is also passed between Layer 2 and Layer 1. Layer 1 converts the PDUs from Layer 2 and system control information into an AM or FM IBOC digital radio broadcasting waveform for transmission. Layer 1 processing can include scrambling, channel encoding, interleaving, OFDM subcarrier mapping, and OFDM signal generation. The output of OFDM signal generation is a complex, baseband, time domain pulse representing the digital portion of an IBOC signal for a particular symbol. Discrete symbols are concatenated to form a continuous time domain waveform, which is modulated to create an IBOC waveform for transmission.

Figure 10:
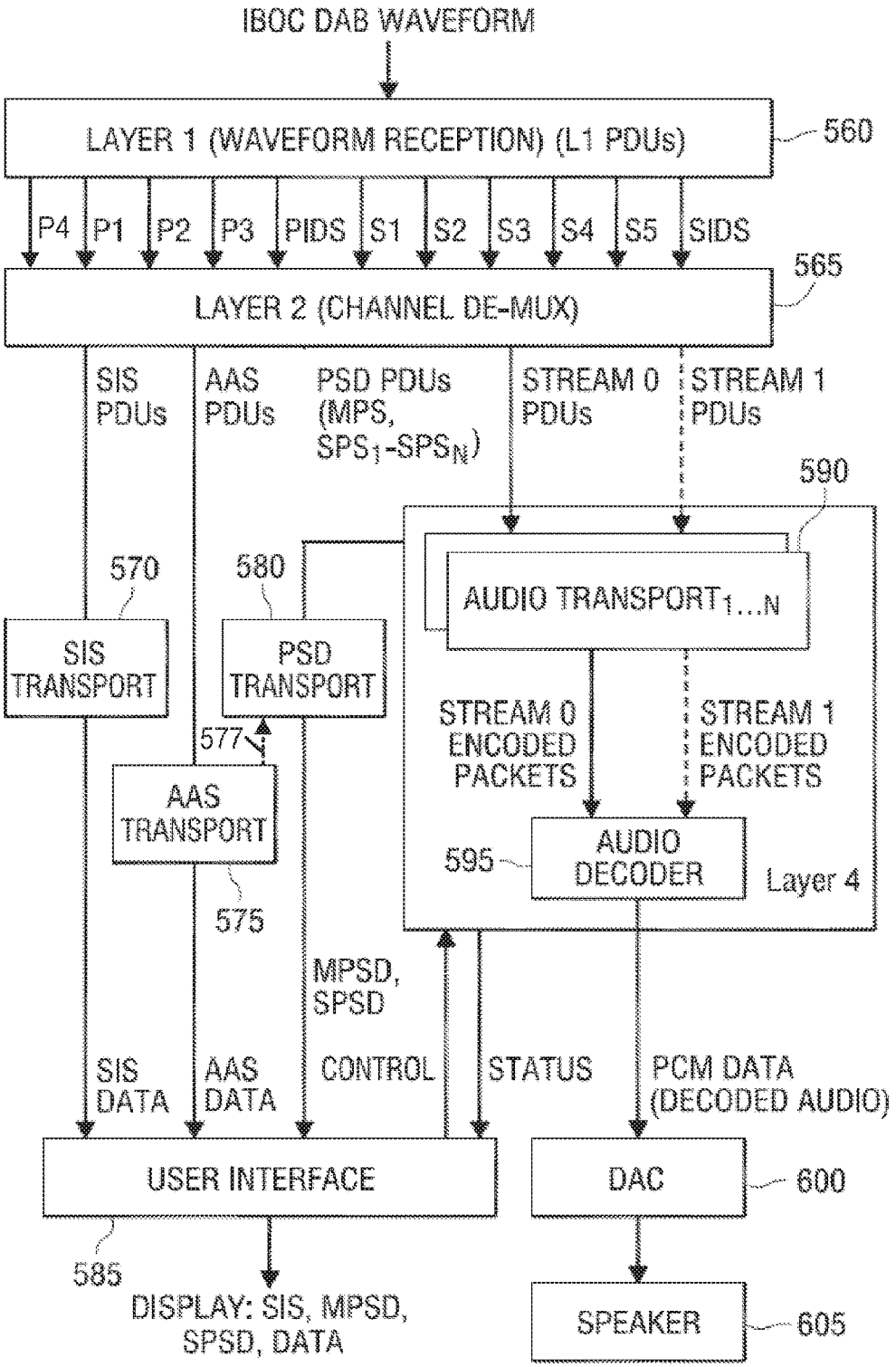
FIG. 10 is a diagram of an IBOC digital radio broadcasting logical protocol stack from the receiver perspective.

FIG. 10 shows a logical protocol stack from the receiver perspective. An IBOC waveform is received by the physical layer, Layer 1 (560), which demodulates the signal and processes it to separate the signal into logical channels. The number and kind of logical channels will depend on the service mode, and may include logical channels P1-P4, Primary IBOC Data Service Logical Channel (PIDS), S1-S5, and SIDS. Layer 1 produces L1 PDUs corresponding to the logical channels and sends the PDUs to Layer 2 (565), which demultiplexes the L1 PDUs to produce SIS PDUs, AAS PDUs, and Stream 0 (core) audio PDUs and Stream 1 (optional enhanced) audio PDUs. The SIS PDUs are then processed by the SIS transport 570 to produce SIS data, the AAS PDUs are processed by the AAS transport 575 to produce AAS data, and the PSD PDUs are processed by the PSD transport 580 to produce MPS data (MPSD) and any SPS data (SPSD). Encapsulated PSD data may also be included in AAS PDUs, thus processed by the AAS transport processor 575 and delivered on line 577 to PSD transport processor 580 for further processing and producing MPSD or SPSD. The SIS data, AAS data, MPSD and SPSD are then sent to a user interface 585. The SIS data, if requested by a user, can then be displayed. Likewise, MPSD, SPSD, and any text based or graphical AAS data can be displayed. The Stream 0 and Stream 1 PDUs are processed by Layer 4, comprised of audio transport 590 and audio decoder 595. There may be up to N audio transports corresponding to the number of programs received on the IBOC waveform. Each audio transport produces encoded MPS packets or SPS packets, corresponding to each of the received programs. Layer 4 receives control information from the user interface, including commands such as to store or play programs, and information related to seek or scan for radio stations broadcasting an all-digital or hybrid IBOC signal. Layer 4 also provides status information to the user interface.

Figure 11:
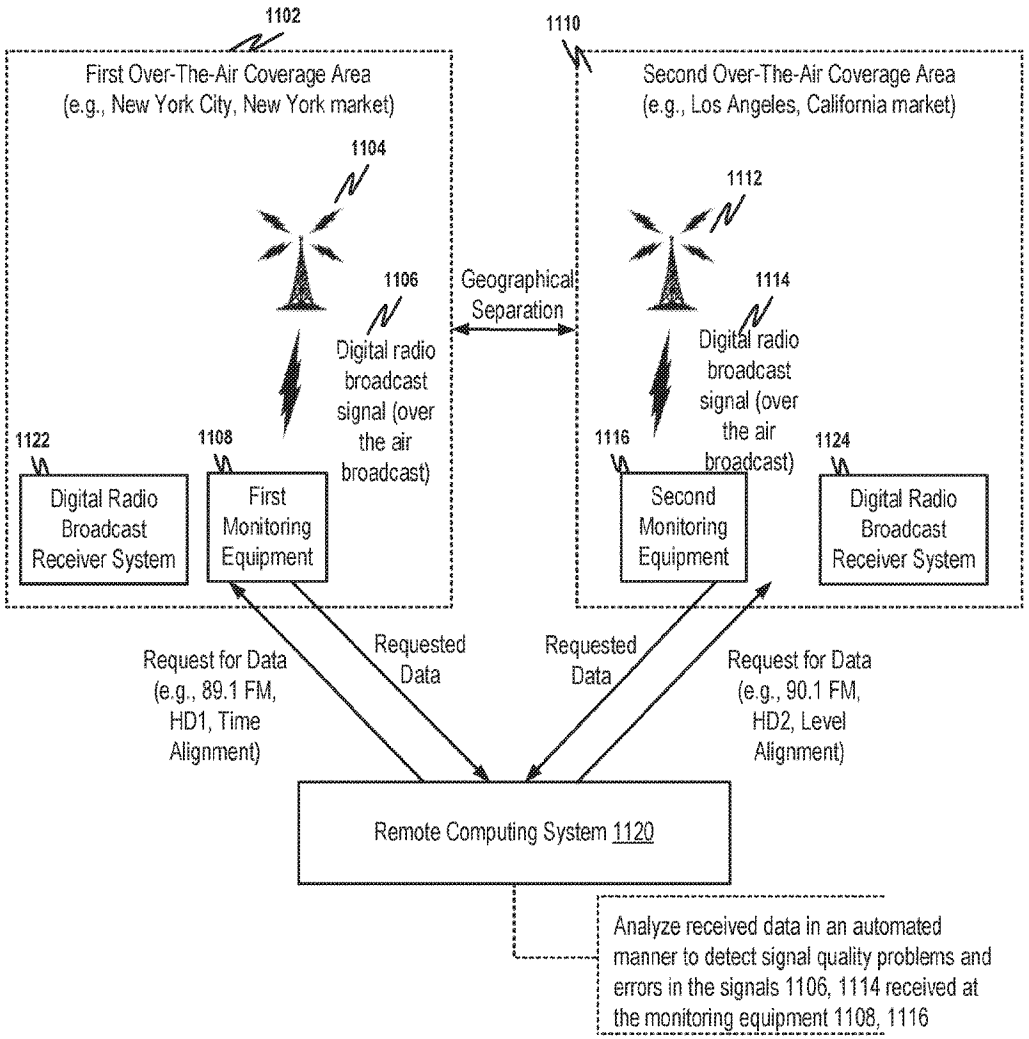
FIG. 11 depicts an example system including (i) first monitoring equipment located in an over-the-air coverage area of a first radio station, and (ii) second monitoring equipment located in an over-the-air coverage area of a second radio station.

FIGS. 11-16 and the accompanying description herein provide a detailed description of exemplary approaches for systems and methods for automated detection of signal quality problems and errors (e.g., errors in content, non-adherence to broadcasting standards, etc.) in digital radio broadcast signals. These approaches may further be used to detect problems in digital radio broadcast transmitter and receiver systems (e.g., software, hardware, and/or firmware issues, etc.). FIG. 11 depicts an example system including first monitoring equipment 1108 located in an over-the-air coverage area 1102 of a first radio station. The first monitoring equipment 1108 may be configured to receive digital radio broadcast signals 1106 via digital radio broadcast transmission. The digital radio broadcast signals 1106 may also be received at a digital radio broadcast receiver system 1122 located in the over-the-air coverage area 1102. The digital radio broadcast receiver system 1122 may be a consumer product that is included as part of an automobile's entertainment system, for instance. The digital radio broadcast signals 1106 may be transmitted from a transmitter 1104 of the first radio station.

The system of FIG. 11 further includes second monitoring equipment 1116 located in an over-the-air coverage area 1110 of a second radio station. The second monitoring equipment 1116 may be configured to receive digital radio broadcast signals 1114 via digital radio broadcast transmission. The digital radio broadcast signals 1114 may also be received at a digital radio broadcast receiver system 1124 located in the over-the-air coverage area 1110. Like the digital radio broadcast receiver system 1122, the digital radio broadcast receiver system 1124 may be a consumer product, for example. Thus, in examples, the first and second monitoring equipment 1108, 1116 receive digital radio broadcast signals that are available to any digital radio broadcast receiver system operating within the respective coverage areas 1102, 1110. The digital radio broadcast signals 1114 may be transmitted from a transmitter 1112 of the second radio station.

In an example, the over-the-air coverage areas 1102, 1110 of the first and second radio stations, respectively, are different (e.g., separated geographically and not overlapping). Thus, as illustrated in the example of FIG. 11, the first over-the-air coverage area 1102 may be located in a "New York City, New York" market, and the second over-the-air coverage area 1110 may be located in a "Los Angeles, Calif." market. It should be understood that these markets are examples only. It should also be understood that the system described herein may include tens, hundreds, or thousands of monitors in various different geographical locations. Thus, although the example of FIG. 11 depicts only first and second monitoring equipment 1108, 1116, it is noted that the approaches described herein are not limited to such two-monitor scenarios. In some examples, multiple monitors may be located in a single over-the-air coverage area.

The system of FIG. 11 further includes a remote computing system 1120. The computing system 1120 is referred to as being "remote" because in the example of FIG. 11, the computing system 1120 is located in neither of the first or second over-the-air coverage areas 1102, 1110. In other examples, the computing system 1120 may be located in one of the first or second over-the-air coverage areas 1102, 1110. The remote computing system 1120 may be used in detecting signal quality problems and errors in digital radio broadcast signals. The remote computing system 1120 may further be used in detecting problems in digital radio broadcast transmitter and receiver systems. All of these problems may negatively affect an end-user's experience (e.g., listening experience, experience viewing information on a display of a receiver system, etc.). For example, the remote computing system 1120 may be used in detecting signal quality problems in the digital radio broadcast signals 1106, 1114. Such signal quality problems may include low signal strength, poor time alignment, poor level alignment, and poor phase alignment, among others.

In embodiments, the monitoring equipment 1108, 1116 are configured to compare analog audio and digital audio received from the respective first and second radio stations and determine whether the two audio sources are properly aligned in time. As explained below, the remote computing system 1120 may transmit requests for data to the first monitoring equipment 1108 and the second monitoring equipment 1116. When the remote computing system 1120 requests "time alignment" data from the monitoring equipment 1108, 1116, the respective monitoring equipment may respond with data indicative of whether the two audio sources are properly aligned in time, as determined using the above-described comparison of the analog audio and digital audio performed by the monitoring equipment. Further, in embodiments, the monitoring equipment 1108, 1116 are configured to measure the relative level and phase between the digital and analog audio sources and determine whether the sources are properly aligned in level and phase. Thus, when the remote computing system 1120 requests "level alignment" data from the monitoring equipment 1108, 1116, the respective monitoring equipment may respond with data indicative of whether the two audio sources are properly aligned in level. The remote monitoring equipment 1108, 1116 may generate this data by comparing the analog audio and digital audio received from the respective first and second radio stations to determine whether the two audio sources are properly aligned in level.

Likewise, when the remote computing system requests "phase alignment" data from the monitoring equipment 1108, 1116, the respective monitoring equipment may respond with data indicative of whether the two audio sources are properly aligned in phase. The remote monitoring equipment 1108, 1116 may generate this data by comparing the analog audio and digital audio received from the respective first and second radio stations to determine whether the two audio sources are properly aligned in phase. Misalignments in time, level, and/or phase may cause audio distortion when a digital radio broadcast receiver blends between analog and digital audio. The monitoring equipment may determine measurements of time and phase alignment by computing the cross correlation between the analog and digital audio samples. The time offset corresponds to the offset that provides the maximum magnitude of cross-correlation peak. If the sign of the cross-correlation peak is negative, this means that the phase alignment is inverted (180 degrees). If the sign is positive, then the phase alignment is zero degrees. The computing of such alignment values is described in further detail in U.S. Pat. No. 8,027,419, which is incorporated herein by reference in its entirety. The monitoring equipment may determine a measurement of level alignment by computing the loudness of the analog and digital audio samples. One algorithm that may be implemented by the monitoring equipment to accomplish this is outlined in ITU-R Standard BS.1770-2 "Algorithms to Measure Audio Programme Loudness and True-Peak Audio Level," which is incorporated herein by reference in its entirety.

The remote computing system 1120 may also be used in detecting errors in the digital radio broadcast signals 1106, 1114. These errors may relate to, for example, (i) the signals' non-compliance with digital radio broadcasting standard, and (ii) errors in the content of the signals 1106, 1114. Thus, in embodiments, the remote computer system 1120 may be used in determining whether the signals 1106, 1114 are compliant with digital radio broadcasting standards. Such standards include, for example, the NRSC-5C Standard known to those of ordinary skill in the art. If the signals 1106, 1114 do not comply with applicable digital radio broadcasting standards, the end-user's experience could be negatively affected. Non-compliant signals can cause numerous issues to an NRSC-5C-compliant receiver, depending on the nature of the non-compliance. For example, a truly non-compliant signal or one that is broadcast in an unsupported NRSC-5C mode may not be received at all. The signal may be correct at the physical layer (i.e., correct modulation and coding) but contain errors in one or more of the application layers. For example, the signal may have errors in the audio transport, causing the receiver to fail to acquire digital audio. In some examples, errors may be sporadic, so that occasional digital audio packets are in error. A receiver may then output distorted digital audio. Another example is an error in the AAS data transport layer, so that the receiver is unable to properly receive traffic data services.

Further, in some examples, non-compliant signals can cause severe faults in receivers (e.g., receiver hardware crashes). A crash may result in a short interruption (several seconds) of reception or in the worst case, the crash may render the receiver totally inoperative, where it no longer responds to user control until the power is removed from the device and subsequently restored. An example of this would be the length field in an audio or data packet being out of bounds or missing delimiters in a data sequence so that the receiver software cannot parse the data into its individual components. Further, incorrect values of parameters sent to control the analog/digital audio blending process may cause issues in receivers. Such incorrect values may result in the receiver having a misalignment between analog and digital audio, too high a digital audio level to the point of clipping/distortion, failure to play digital audio and only playing analog audio, or muting of the receiver audio altogether.

The remote computing system 1120 may also be used in detecting errors in the content of the signals 1106, 1114, as noted above. For instance, the remote computing system 1120 may analyze data received from the monitoring equipment 1108, 1116 to determine if the first and second radio stations are broadcasting all required text fields. If the stations are broadcasting music, for example, the data may be analyzed to ensure that the "artist" text field is populated in the stations' broadcasts. As another example, if the first radio station intends to broadcast traffic information, the remote computing system 1120 may analyze data received from the monitoring equipment 1108 to ensure that the broadcast signal 1106 actually includes such traffic information. In other examples, the intended content may include, for instance, images (e.g., album covers, artist pictures, etc.), artist name, song title, and album title, among other content. The remote computing system 1120 may be used in detecting if such content is missing or incorrect in digital radio broadcast signals. When signal quality problems and/or errors in the content of signals are detected by the remote computing system 1120, such issues may be indicative of problems in the transmitter systems (e.g., hardware, software, firmware, etc.) used by radio stations. It is thus noted that the systems and methods described herein may be used in detecting problems in digital radio broadcasting transmitter systems.

The remote computing system 1120 may also be used in detecting problems that are related to end-users' digital radio broadcast receiver systems 1122, 1124. In some instances, the consumer's digital radio broadcast receiver system may experience a fault (e.g., fail to render audio or visual data properly, etc.) despite the fact that broadcasted signals have little or no signal quality problems and are error-free or relatively error-free. In these instances, there may be an issue with the digital radio broadcast receiver system's hardware, software, or firmware, for instance. The remote computing system 1120 may be used in detecting such problems that are associated with the digital radio broadcast receiver systems 1122, 1124, as described in further detail below.

To detect the problems described above (e.g., signal quality problems, errors in broadcasted signals, problems in transmitter and/or receiver systems, etc.), the remote computing system 1120 may transmit requests for data to the first monitoring equipment 1108 and the second monitoring equipment 1116. The requested data may include digital audio data and data services (e.g., weather, news, traffic, sports scores, metadata related to a song, etc.) that are received at the monitoring equipment 1108, 1116 during a given time period. In some embodiments, all fields of data (e.g., all digital audio data and data services) received by the equipment 1108, 1116 during a given time period may be requested by the remote computing system 1120. Such data can provide the remote computing system 1120 with an exact picture of the data that is received at end-users' receivers in the respective coverage areas 1102, 1110 during the given time period. Such data may further provide the remote computing system 1120 with an exact picture of the station configurations of the respective first and second radio stations. With this data, the remote computing system 1120 can detect, for example, whether the broadcasted signals 1106, 1114 are compliant with applicable broadcast standards and/or whether the signals 1106, 1114 include content errors (e.g., missing content, incorrect content, etc.). The requested data may also be indicative of a signal quality of digital radio broadcast signals received at the respective monitoring equipment 1108, 1124. For example, the requested data may be indicative of signal strength, time alignment, phase alignment, and/or level alignment of the respective signals 1106, 1114, for example.

As illustrated in the example of FIG. 11, the remote computing system 1120 may transmit a request for data to the first monitoring equipment 1108, where the request specifies "89.1 FM, HD1 Audio, Time Alignment." A format of the request may vary in different examples. Additional details about the format of the request are described below with reference to FIGS. 12A-13. In this example, "89.1 FM" is a frequency at which a digital radio broadcast signal is transmitted by a radio station in the first over-the-air coverage area 1102, "HD1 Audio" specifies that data is requested for HD1 Audio (as opposed to HD2, HD3, and HD4 audio, etc.), and "Time Alignment" specifies that data is requested for a "time alignment" attribute of the digital radio broadcast signal. The monitoring equipment 1108 may be configured to generate time alignment data by comparing digital audio and analog audio received at the monitoring equipment 1108 to determine if the two audio sources are aligned in time, as described above. As described in further detail below, if a time alignment attribute of the digital radio broadcast signal is low, then a user may experience audio quality problems (e.g., echo, feedback, etc.).

In an example, the request serves as control data for controlling the first monitoring equipment 1108. Thus, in this example, based on its receipt of the request from the remote computing system 1120, the first monitoring equipment 1108 may tune to the 89.1 FM frequency and begin receiving HD1 audio via a digital radio broadcast signal. Further, based on its receipt of the request, the first monitoring equipment 1108 may generate and transmit data indicative of the "time alignment" attribute of the received digital radio broadcast signal to the remote computing system 1120. This is the data requested by the remote computing system 1120, and FIG. 11 illustrates the requested data being transmitted from the first monitoring equipment 1108 to the remote computing system 1120.

Similarly, the remote computing system 1120 may transmit a request for data to the second monitoring equipment 1116, where the request specifies "90.1 FM, HD2 Audio, Level Alignment." "90.1 FM" is a frequency at which a digital radio broadcast signal is transmitted by a radio station in the second over-the-air coverage area 1110, "HD2 Audio" specifies that data is requested for HD2 Audio (as opposed to HD1, HD3, and HD4 audio, etc.), and "Level Alignment" specifies that data is requested for a "level alignment" attribute of the digital radio broadcast signal. The monitoring equipment 1116 may be configured to generate level alignment data by comparing digital audio and analog audio received at the monitoring equipment 1116 to determine if the two audio sources are aligned in level, as described above. As described in further detail below, if a level alignment attribute of the digital radio broadcast signal is low, then a user may experience audio quality problems (e.g., inadequate volume, etc.).

In an example, the request serves as control data for controlling the second monitoring equipment 1116. Thus, in this example, based on its receipt of the request from the remote computing system 1120, the second monitoring equipment 1116 may tune to the 90.1 FM frequency and begin receiving HD2 audio via a digital radio broadcast signal. Further, based on its receipt of the request, the second monitoring equipment 1116 may generate and transmit data indicative of the "level alignment" attribute of the received digital radio broadcast signal to the remote computing system 1120. FIG. 11 illustrates the requested data being transmitted from the second monitoring equipment 1116 to the remote computing system 1120.

The remote computing system 1120 may receive the requested data from the first and second monitoring equipment 1108, 1116. As described above, the requested data may include (i) digital audio data and data services that are received at the monitoring equipment 1108, 1116, and/or (ii) data indicative of a signal quality of signals received at the monitoring equipment 1108, 1116, among other data. After receiving the requested data, the remote computing system 1120 may be configured to analyze the received data to detect signal quality problems and/or errors in the signals 1106, 1114. The remote computing system 1120 may be configured to perform such analysis in an automated manner that requires no human intervention or minimal human intervention. In an example, the analysis includes comparing the data received from the first and second monitoring equipment 1108, 1116 to one or more predetermined threshold values. In other examples, the analysis includes comparing the data received from the first and second monitoring equipment 1108, 1116 to data indicative of a baseline standard for signals broadcasted according to a digital radio broadcasting standard. In other examples, the analysis includes analyzing the data received from the first and second monitoring equipment 1108, 1116 to determine if the content of received signals matches an expected content of the signals.

For example, as described above, the remote computing system 1120 may request from the first monitoring equipment 1108 data indicative of the "time alignment" attribute of an 89.1 FM, HD1 Audio digital radio broadcast signal in the first over-the-air coverage area 1102. After receiving the requested data, the remote computing system 1120 may compare the data to a time alignment threshold value. If the data is less than the threshold value, then the remote computing system 1120 may determine that the digital radio broadcast signal has a signal quality problem relating to its time alignment. In other examples, multiple threshold values may be employed (e.g., threshold values that are used to classify the time alignment attribute as being excellent, good, fair, poor, etc.). The remote computing system 1120 may generate an alarm signal or an alert signal based upon the detection of a problem. Such an alarm signal or alert signal may be transmitted to a radio station, thus informing the radio station of the problem. Alerts may be transmitted to other persons or organizations in other examples.

In an embodiment, the remote computing system 1120 performs the analysis in real-time or near real-time, such that the analysis is near the time at which the digital radio broadcast signal is broadcasted, thus enabling problems to be detected and corrected soon after the problems develop. In this regard, analysis in real-time involves the computing system 1120 analyzing the data received from the monitoring equipment 1108, 1116 upon receipt of the data by the computing system 1120, so that any delays in analyzing the digital radio broadcast signals are minimal and amount to merely transmission delays incurred in transmitting the data from the monitoring equipment 1108, 1116 to the computing system 1120. Analysis in near real-time involves the computing system 1120 analyzing the data received from the monitoring equipment 1108, 1116 within some short time period after receipt of the data by the computing system 1120 (e.g., within 1 minute, 5 minutes, 10 minutes, 15 minutes, 20 minutes or up to 30 minutes after receipt of the data from the monitoring equipment 1108, 1116 by the computing system 1120, etc.).

In examples, the remote computing system 1120 is configured to analyze the requested data from the first and second monitoring equipment 1108, 1116 simultaneously or substantially simultaneously. Although the example of FIG. 11 illustrates a system including only first and second monitoring equipment 1108, 1116, in other examples, the remote computing system 1120 may receive data from tens, hundreds, or thousands of monitors located anywhere in the world. In these other examples, the remote computing system 1120 may be configured to analyze the received data from the tens, hundreds, or thousands of monitors simultaneously or substantially simultaneously. Such data may be analyzed and monitored at the remote computing system 1120 at all times (e.g., analysis and monitoring 24 hours a day, 7 days a week), thus enabling problems to be detected at any time of the day and week. The remote computing system 1120 may further be configured to continuously (or nearly continuously) (i) send out requests for data to the tens, hundreds, or thousands of monitors, and (ii) receive data from these monitors.

The systems and methods described herein may have advantages over manual approaches to addressing problems in digital radio broadcast signals, transmitter systems, and receiver system. As described previously herein, in a manual approach an engineer would, for example, be notified of a potential issue regarding problems in a particular geographic area, travel to the area with expensive equipment, record signal data, and return to a laboratory to analyze the data, Such a process can be burdensome, time consuming, expensive, and slow. By contrast, in the approaches described herein, the monitoring equipment 1108, 1116 and remote computing system 1120 may monitor and detect problems in a proactive manner, i.e., the problems are detected near the time at which the problems first develop and are not known only based on reports from end-users, etc. Also, in the approaches described herein, once monitoring equipment has been placed in desired areas (e.g., in different radio markets, etc.), all monitoring and analysis may be performed remotely and without a need for human intervention (or requiring only minimal human intervention). Further, the remote computing system 1120 described herein may analyze data received from tens, hundreds, or thousands of monitors simultaneously or substantially simultaneously, where such monitors may be collecting data from multiple (e.g., tens, hundreds, or thousands) radio stations. The remote computing system 1120 may detect problems associated with any of these stations based on its analyses. Further, the remote computing system 1120 may send out requests to all of the different monitors around the country (or the world) and tune/analyze them systematically and decide what to do with that data based on predetermined thresholds and/or other data (e.g., data indicative of baseline standards for transmitted signals, data indicative of expected content, etc.).

Figure 12A:
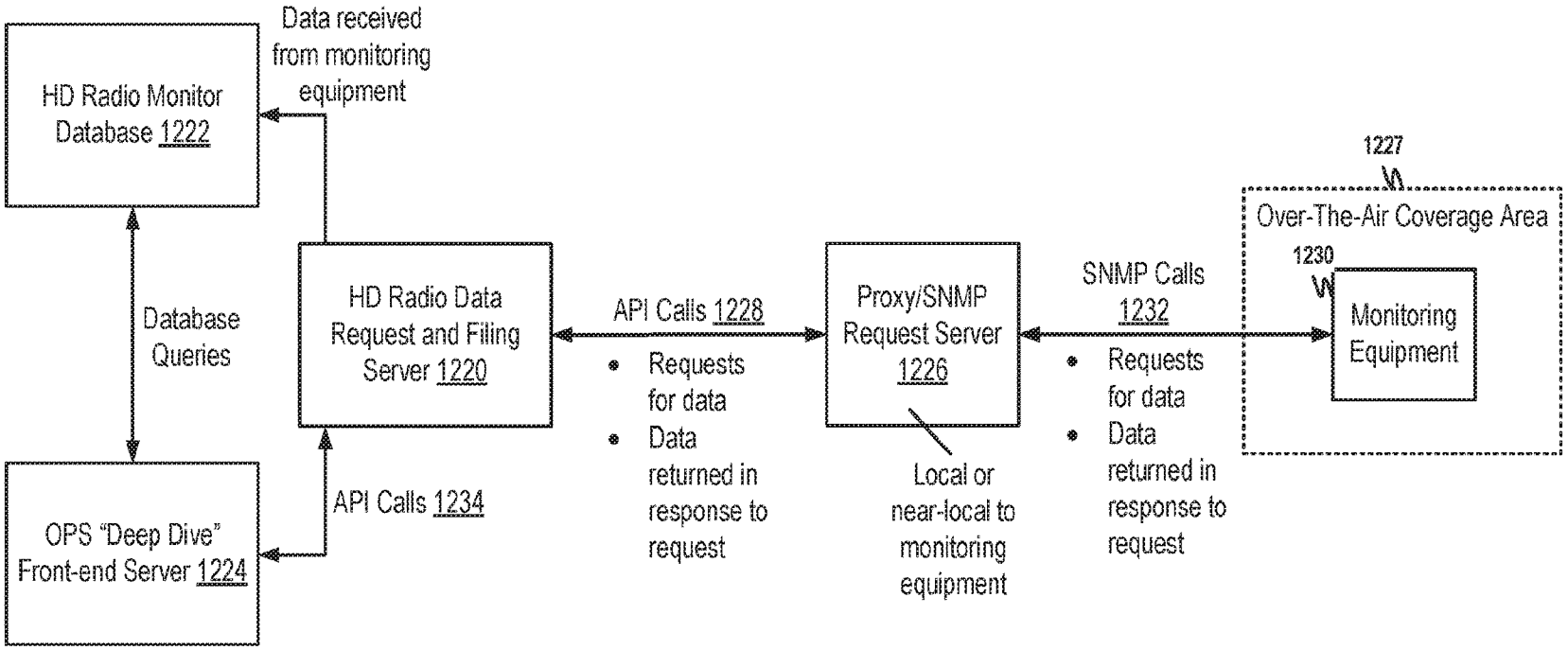
FIG. 12A is a block diagram depicting an example system for automated detection of signal quality problems and errors in digital radio broadcast signals.

FIG. 12A is a block diagram depicting an example system for automated detection of signal quality problems and errors in digital radio broadcast signals. In the example of FIG. 12A, monitoring equipment 1230 is located in an over-the-air coverage area 1227 of a radio station. The monitoring equipment 1230 is configured to receive digital radio broadcast signals via digital radio broadcast transmission from the radio station. The example of FIG. 12A further includes HD Radio Data Request and Filing Server 1220. The HD Radio Data Request and Filing Server 1220 may perform one or more of the functions described above as being performed by the remote computing system 1120 of FIG. 11. Thus, the HD Radio Data Request and Filing Server 1220 may be configured to transmit requests for data to the monitoring equipment 1230. The HD Radio Data Request and Filing Server 1220 may further be configured to receive the requested data from the monitoring equipment 1230 and to analyze, in real-time or near real-time, the received data to detect signal quality problems and errors in the digital radio broadcast signals received by the monitoring equipment 1230. The HD Radio Data Request and Filing Server 1220 may further analyze the requested data to detect problems in receiver systems and transmitter systems and/or to assist in the detection of such problems.

To transmit requests for data from the HD Radio Data Request and Filing Server 1220 to the monitoring equipment 1230, the example system of FIG. 12A utilizes a Proxy/SNMP Request Server 1226. In an example, the Proxy/SNMP Request Server 1226 is local or near-local to the monitoring equipment 1230. As described above, monitors may be placed at various locations throughout the world. In an example, each designated region of the world has a single Proxy/SNMP Request Server 1226. The single Proxy/SNMP Request Server 1226 communicates with all monitors located within its associated region. For example, a "northeast" region of the United States may include monitors in New York City and Boston, and a single Proxy/SNMP Request Server 1226 may be associated with all of the monitors in these two cities. For these reasons, the Proxy/SNMP Request Server 1226 is said to be "local or near-local" to the monitoring equipment 1230. By contrast, the HD Radio Data Request and Filing Server 1220 may be located anywhere in the world, and the server 1220 need not be located near the monitoring equipment 1230 or the Proxy/SNMP Request Server 1226.

To use the Proxy/SNMP Request Server 1226 to transmit requests to the monitoring equipment 1230, the HD Radio Data Request and Filing Server 1220 may communicate with the Proxy/SNMP Request Server 1226 via application program interface (API) calls 1228. Using the API calls 1228, the HD Radio Data Request and Filing Server 1220 may request data from the monitoring equipment 1230 (e.g., 89.1 FM, HD1 Audio, Time Alignment data, etc.). To relay this request to the monitoring equipment 1230, the Proxy/SNMP Request Server 1226 may use the Simple Network Management Protocol (SNMP) protocol. Thus, the Proxy/SNMP Request Server 1226 may transmit the request of the HD Radio Data Request and Filing Server 1220 to the monitoring equipment via SNMP calls 1232. Based on the received request, the monitoring equipment 1230 may tune to the specified frequency to acquire the requested data. The monitoring equipment 1230 may then transmit the requested data to the Proxy/SNMP Request Server 1226 using the SNMP protocol. The Proxy/SNMP Request Server 1226 may in turn transmit the requested data to the HD Radio Data Request and Filing Server 1220.

The data received at the HD Radio Data Request and Filing Server 1220 may be stored in an HD Radio Monitor Database 1222. In an example, the data in the HD Radio Monitor Database 1222 is monitored and analyzed in real-time or near real-time. The data in the HD Radio Monitor Database 1222 may be monitored and analyzed, for example, by the HD Radio Data Request and Filing Server 1220 or by another computer system coupled to the HD Radio Monitor Database 1222. The HD Radio Data Request and Filing Server 1220 or the other computer system may query the database 1222 and monitor and analyze the data returned based on such queries. The monitoring and analysis of the data in real-time or near real-time may allow problems to be detected shortly after they first arise. In an example, when a problem is detected by the HD Radio Data Request and Filing Server 1220 or the computer system coupled to the HD Radio Monitor Database 1222, the server 1220 or the computer system may generate an alert signal and cause this alert signal to be transmitted to appropriate recipients (e.g., a radio station associated with the digital radio broadcast signal having the problem). In other examples where the HD Radio Data Request and Filing Server 1220 monitors and analyzes the data from the monitoring equipment 1230, the server 1220 does so prior to storing the received data in the HD Radio Monitor Database 1222. This may allow for faster detection of problems (e.g., problems may be detected prior to storing the data in the database 1222 and without a need to query the database 1222). It should be appreciated that the automated, real-time (or near real-time) analysis of data and detection of problems may be performed in a variety of different manners and using a variety of different systems and methods. Thus, it is noted that the scope of this disclosure is not limited to the specific embodiments described herein.

The example system of FIG. 12A may further include the OPS Deep Dive Front-end Server 1224. The OPS Deep Dive Front-end Server 1224 may transmit database queries to the HD Radio Monitor Database 1222, thus enabling the OPS Deep Dive Front-end Server 1224 to monitor data stored in the database 1222. Based on such monitoring of data, the OPS Deep Dive Front-end Server 1224 may communicate with the HD Radio Data Request and Filing Server 1220 and use such communications to take control of the monitoring equipment 1230 in real-time.

Figure 12B:
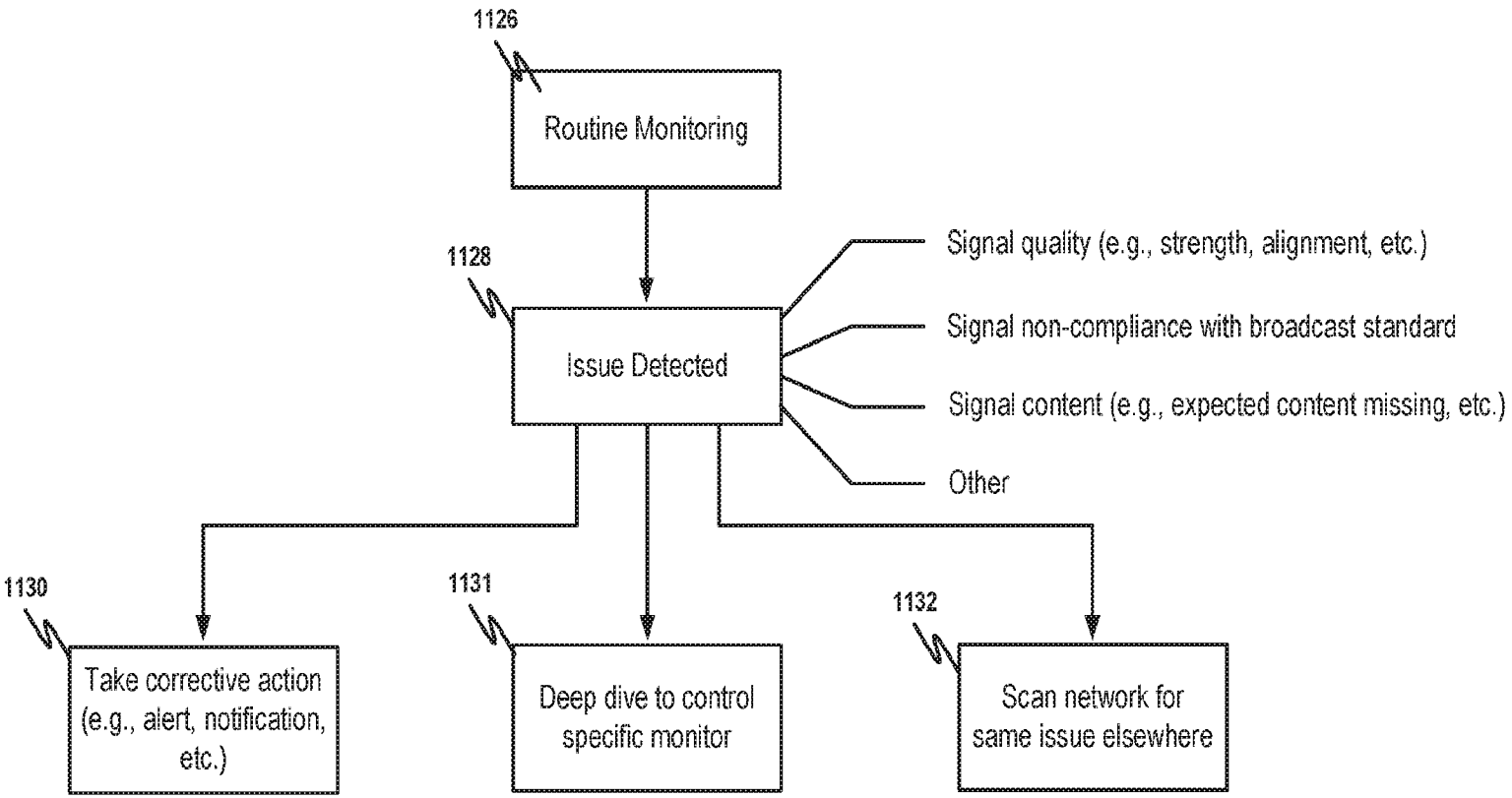
FIGS. 12B and 12C are flowcharts depicting example processes performed by the system of FIG. 12A for detecting and correcting signal quality problems and errors in digital radio broadcast signals.

To illustrate an example process performed by the system of FIG. 12A, reference is made to FIG. 12B. In an example, the HD Radio Data Request and Filing Server 1220 may send requests for data to the monitoring equipment 1230 as part of a "routine monitoring" operation. The routine monitoring operation is depicted in FIG. 12B at step 1126. For example, the HD Radio Data Request and Filing Server 1220 may send requests to the monitoring equipment 1230 that iterate through various frequencies, various HD Radio audio (e.g., HD1, HD2, HD3 audio, etc.), and various variables (e.g., different fields of digital audio data and data services transmitted by the transmitter, variables relating to time alignment, level alignment, phase alignment, and signal strength attributes of received signals, etc.) in a repetitive and predictable fashion. Such routine monitoring 1126 may thus be carried out in an automated manner (e.g., according to algorithms that generate requests that iterate through the various frequencies and variables). The data received as part of the routine monitoring 1126 may relate to multiple different radio stations, e.g., by iterating through the various frequencies, etc. The data received as part of the routine monitoring 1126 may be stored in the HD Radio Monitor Database 1222 and analyzed by the HD Radio Data Request and Filing Server 1220 and/or the OPS Deep Dive Front-end Server 1224, for instance.

At step 1128, based on the routine monitoring analysis, a potential problem may be detected in the received data. As indicated in the figure, the problem may relate to a signal quality issue, signal non-compliance with applicable broadcasting standards, signal content issues (e.g., expected content missing, content incorrect, etc.), or another issue. Signal quality issues relating to low signal strength, poor time alignment, poor level alignment, and/or poor phase alignment may be determined by comparing data indicative of these signal attributes to predetermined threshold values, as described above with reference to FIG. 11. Further, for example, it may be determined that a radio station is broadcasting a signal that is not compliant with applicable digital radio broadcasting standards by comparing the received data to data indicative of a baseline standard for signals broadcasted according to a digital radio broadcasting standard. An example digital radio broadcasting standard is the NRSC-5C standard, known to those of ordinary skill in the art. In examples, a computer-based system (e.g., HD Radio Data Request and Filing Server 1220 and/or the OPS Deep Dive Front-end Server 1224) checks the physical layer signaling bits to verify that the service mode is supported and that the associated system control data bits do not define an illegal combination of bits. Similarly, the computer-based system checks the audio and data transport layers to confirm that their signaling bits (such as audio mode, blend control bits) define a supported mode of operation. Further, the computer-based system may check the audio and data packet integrity by computing packet CRC errors. The quality of the digital modulation can also be checked by computing the modulation error ratio, which is a measure of the digital data signal to noise ratio. In other examples, additional analysis may be performed.

Likewise, it may be determined that a radio station is not broadcasting correct content by comparing the data received as part of the routine monitoring operations 1126 to data indicative of the content that should be broadcasted by the station. For instance, a database may identify all stations that should be broadcasting traffic information. Thus, for stations that should be broadcasting traffic information, the received data can be analyzed to determine if such information is in fact being broadcasted. In examples, a computer-based system (e.g., HD Radio Data Request and Filing Server 1220 and/or the OPS Deep Dive Front-end Server 1224) verifies that the SIS channel contains the appropriate "Scan code," indicating the presence of traffic data. In addition, the SIG channel is checked for the presence of the appropriate signaling information used to identify a data port number devoted to traffic. The computer-based system may further analyze the traffic data port to confirm that there is activity on the port. In other examples, additional analysis may be performed.

As another example, when audio for a song is being broadcasted, a picture and song name should be broadcasted contemporaneously, in some embodiments (e.g., such that the picture and song name can be displayed on a display of the receiver at the same time that the audio is being rendered). By analyzing data received as part of the routine monitoring operations 1126, it can be determined if stations are failing to broadcast the picture and song name data. More generally, this data analysis can be used to verify proper time synchronization between broadcast data (e.g., to verify proper time synchronization between audio, PSD, and album art images, etc.), and to detect other such issues related to signal content. In examples, a computer-based system (e.g., HD Radio Data Request and Filing Server 1220 and/or the OPS Deep Dive Front-end Server 1224) verifies that an album art image file is received in advance of the image display trigger for that file sent in PSD. Audio, PSD, and album art data can also be stored in a file for playback later, when a listener can determine if the audio is aligned with the data. In other examples, additional analysis may be performed.

In some examples, the analysis of the data performed by the HD Radio Data Request and Filing Server 1220 or Deep Dive Front-end Server 1234 may focus on a presence or absence of data that should be broadcasted (e.g., whether traffic information is being broadcasted or not), and in other examples, the analysis may focus on whether the broadcasted data is correct or incorrect. For example, data received from the monitor 1230 can be analyzed to verify the integrity of each textual field. This analysis can be performed to ensure that radio stations are sending their intended call sign, and also to ensure that all associated formatting information, such as delimiters and text encoding method indicators, are correct. In examples, a computer-based system (e.g., HD Radio Data Request and Filing Server 1220 and/or the OPS Deep Dive Front-end Server 1224) checks call signs to verify that they contain the correct number of characters and in the case of signals broadcast in the United States, that they start with a "W" or "K" character. The computer-based system can also verify call signs against a pre-stored database of call signs versus geographic location and frequency.

Likewise, for example, data received from the monitor 1230 can be analyzed to determine whether "artist name" fields in the received data actually reflect artist names, as opposed to other, incorrect data. In examples, a computer-based system (e.g., HD Radio Data Request and Filing Server 1220 and/or the OPS Deep Dive Front-end Server 1224) verifies that the artist name does not contain illegal characters (such as a tab character), the text encoding indicator byte shows a supported encoding method, the artist name contains at least one displayable character, and does not exceed the specified maximum number of characters. Further, in embodiments, the content analysis performed by the server 1220 or server 1224 may be used to ensure the integrity of data service broadcasts, including signaling information in SIS and SIG. SIS and SIG information is required by receivers to scan the band to discover a desired data service and subsequently to open the correct data port to read the data service and to render information on the display screen. Thus, by analyzing data received from the monitor 1230 as part of the routine monitoring 1126, it can be determined if stations are failing to broadcast such SIS and SIG information. SIS and SIG contain similar information, and thus, a consistency check can be performed between these two signaling channels. The contents of the channels can also be inspected for missing data fields. Specific data services are indicated in SIS by "scan codes" and in SIG by "mime hash values." These fields can be checked against a known table of values to confirm that they are correct. SIG can also be checked to confirm that an undefined port number is not being indicated.

In other examples, the content analysis performed by the servers 1220, 1224 may be used to verify the integrity of broadcasted audio programs, e.g., to ensure that the audio programs do not include long periods of silence, among other issues. In examples, a computer-based system (e.g., the server 1220, the server 1224, etc.) determines silence by analyzing the digital audio samples and comparing them to a threshold. If all of the samples fall below a predetermined threshold over a certain time period, then the computer-based system can determine that the signals include silence. Silence may also occur because of a fault in the audio transport. The data provided by the monitoring equipment includes a measure of the digital audio quality, based on integrity of audio transport packets. If the quality is very low, or zero, then digital audio will not be output by the receiver.

To perform the various types of content analysis described herein, the requests transmitted to the monitoring equipment 1230 from the server 1220 may request all fields of audio data and data services received at the monitoring equipment 1230 or a specific subset of these fields. The fields of data received from the monitoring equipment 1230 can then be analyzed by the server 1220 or the server 1224 as described above.

In some instances, when a problem is detected at the step 1128, the routine monitoring may be interrupted. For example, when the server 1220 or server 1224 detects a certain condition based on its analysis of the data received as a result of the routine monitoring, the OPS Deep Dive Front-end Server 1224 may interrupt the routine monitoring. Thus, instead of using the HD Radio Data Request and Filing Server 1220 to receive the data described above (e.g., iterating through various frequencies, HD Radio audio, and variables), the OPS Deep Dive Front-end Server 1224 may communicate with the HD Radio Data Request and Filing Server 1220 and use these communications to (i) take control of the monitoring equipment 1230 in real-time, and (ii) request particular data related to the observed condition. Such actions implement a "deep dive" functionality, as shown at step 1131 in FIG. 12B.

When using the deep dive functionality, for example, the OPS Deep Dive Front-end Server 1224 may communicate with the HD Radio Data Request and Filing Server 1220 and use these communications to request from the monitoring equipment 1230 all data available for a particular radio station. The data available for the particular radio station may include all fields of digital audio data and data services transmitted by the radio station and all variables relating to signal quality attributes of received signals (e.g., variables relating to time alignment, level alignment, phase alignment, and signal strength attributes, etc.). This data may be used by the OPS Deep Dive Front-end Server 1224 to diagnose a problem associated with the signals broadcasted by the particular radio station. The request for all data available for the particular radio station may differ from the routine monitoring requests that are transmitted from the HD Radio Data Request and Filing Server 1220 to the monitoring equipment 1230, which, as described above, may relate to multiple different radio stations.

The data received through the use of the deep dive functionality may be analyzed in various ways. For example, in the deep dive analysis, the monitoring equipment 1230 may return all fields of audio data and data services broadcasted by a particular radio station, and this data may be analyzed to determine if the station's broadcasts are compliant with applicable digital radio broadcasting standards. Such analysis may involve comparing the fields of audio data and data services to data indicative of a baseline standard for signals broadcasted according to a digital radio broadcasting standard, as described above. Similarly, the received data may be analyzed to determine if the station's broadcasts are compliant with other standards (e.g., application-level standards). For instance, stations may broadcast images in formats that cannot be rendered on digital radio broadcast receivers (e.g., if a station broadcasts images in an Adobe format, rather than the JPEG format, such images may not display correctly on receivers). In examples, the computer-based system may perform an analysis that includes checks for a proper file format indicator, a start of image marker, an end of image marker, checks that the pixel resolutions are within specified bounds, the color depth indicator adheres to the applicable standard, and the overall file size is less than the specified limit. In examples, the analysis includes checking that the image file does not include unsupported extensions to the image format such as progressive scan. Further, in examples, the computer-based system validates images based on a list of valid file formats for a digital radio broadcasting standard, where the list may be stored in a database or other non-transitory computer-readable storage medium, for example.

By analyzing the received data, images that are broadcasted in incorrect formats can be identified. As another example, the data received through the use of the deep dive functionality may be analyzed to ensure that no text field in the broadcasted data exceeds a maximum specified length. It is noted that in embodiments, the data analysis performed as part of the routine monitoring 1126 may be the same as or similar to the data analysis performed as part of the deep dive functionality. Thus, all of the signal quality problems and errors that may be detected through the routine monitoring analysis may also be detectable through the deep dive functionality, and vice versa. The deep dive functionality may enable more signal quality problems and errors to be detected for a particular radio station, however, because all data for the station may be received and analyzed during the deep drive analysis. This is in contrast to the routine monitoring operation, under which only a certain limited number of variables for the station may be received and analyzed, in embodiments.

To use the HD Radio Data Request and Filing Server 1220 to take control of the monitoring equipment 1230, the OPS Deep Dive Front-end Server 1224 may communicate with the HD Radio Data Request and Filing Server 1220 via API calls 1234. Using the API calls 1234, the OPS Deep Dive Front-end Server 1224 may request data from the monitoring equipment 1230 (e.g., all data from a certain radio station, etc.). The request or requests are passed from the HD Radio Data Request and Filing Server 1220 to the monitoring equipment 1230 via the Proxy/SNMP Request Server 1226, as described above. The data requested from the monitoring equipment 1230 is passed from the monitoring equipment 1230 to the Proxy/SNMP Request Server 1226 to the HD Radio Data Request and Filing Server 1220 and finally to the OPS Deep Dive Front-end Server 1224, in an embodiment.

In other examples, after the issue is detected at the step 1128, the deep dive functionality is not utilized. Instead, for example, a different corrective action may be performed, as shown at step 1130 of FIG. 12B. In one embodiment, when an issue is detected by the HD Radio Data Request and Filing Server 1220 or the computer system coupled to the HD Radio Monitor Database 1222, the server 1220 or the computer system may generate an alert signal and cause this alert signal to be transmitted to appropriate recipients (e.g., a radio station associated with the digital radio broadcast signal having the problem).

In other examples, after the issue is detected at the step 1128, the system of FIG. 12A may perform actions to determine if similar issues exist elsewhere (e.g., in other parts of the country, other parts of the world, etc.), as shown at step 1132 of FIG. 12B. To determine this, the HD Radio Data Request and Filing Server 1220 may send requests for data to monitoring equipment located in various different over-the-air coverage areas. The requests for data may request data that can be used in determining whether the issue could exist elsewhere. For example, if the issue detected at the step 1128 relates to high-bit-rate parametric stereo broadcasts in the particular coverage area 1227, the HD Radio Data Request and Filing Server 1220 may send requests for data to monitoring equipment in other parts of the world to identify all radio stations broadcasting parametric stereo audio and the bit rates being used by the stations. Using the network of monitoring equipment located in different over-the-air coverage areas around the world and the data received based on the requests, it can be determined whether the issue with the high-bit-rate parametric stereo broadcasts could exist elsewhere, and how extensive the issue could be (e.g., how many radio stations are broadcasting the potentially problematic data, etc.). In embodiments, the HD Radio Data Request and Filing Server 1220 can execute a script to send requests for specific data to the multiple different monitoring equipment located around the world. It is noted that the above description regarding the high-bit-rate parametric stereo broadcasts is merely an example, and in other examples, different data is requested from monitoring equipment located in different over-the-air coverage areas.

Although the example of FIG. 12A depicts the single monitoring equipment 1230 and the single Proxy/SNMP Request Server 1226, it should be appreciated that in other examples, there may be multiple (e.g., tens, hundreds, thousands) monitors and multiple Proxy/SNMP Request Servers. As described above, monitors may be positioned throughout the world. Consequently, multiple Proxy/SNMP Request Servers may be positioned throughout the world, thus enabling the Proxy/SNMP Request Servers to be local or near-local to one or more of the monitors. For example, a first Proxy/SNMP Request Server may be positioned in a "northeast" region of the country, and this first server may serve as an intermediary between the HD Radio Data Request and Filing Server 1220 and tens, hundreds, or thousands of monitors located in the northeast region. A second Proxy/SNMP Request Server may be positioned in a "California" region of the country, and this second server may serve as an intermediary between the HD Radio Data Request and Filing Server 1220 and the tens, hundreds, or thousands of monitors located in the California region.

Figure 12C:
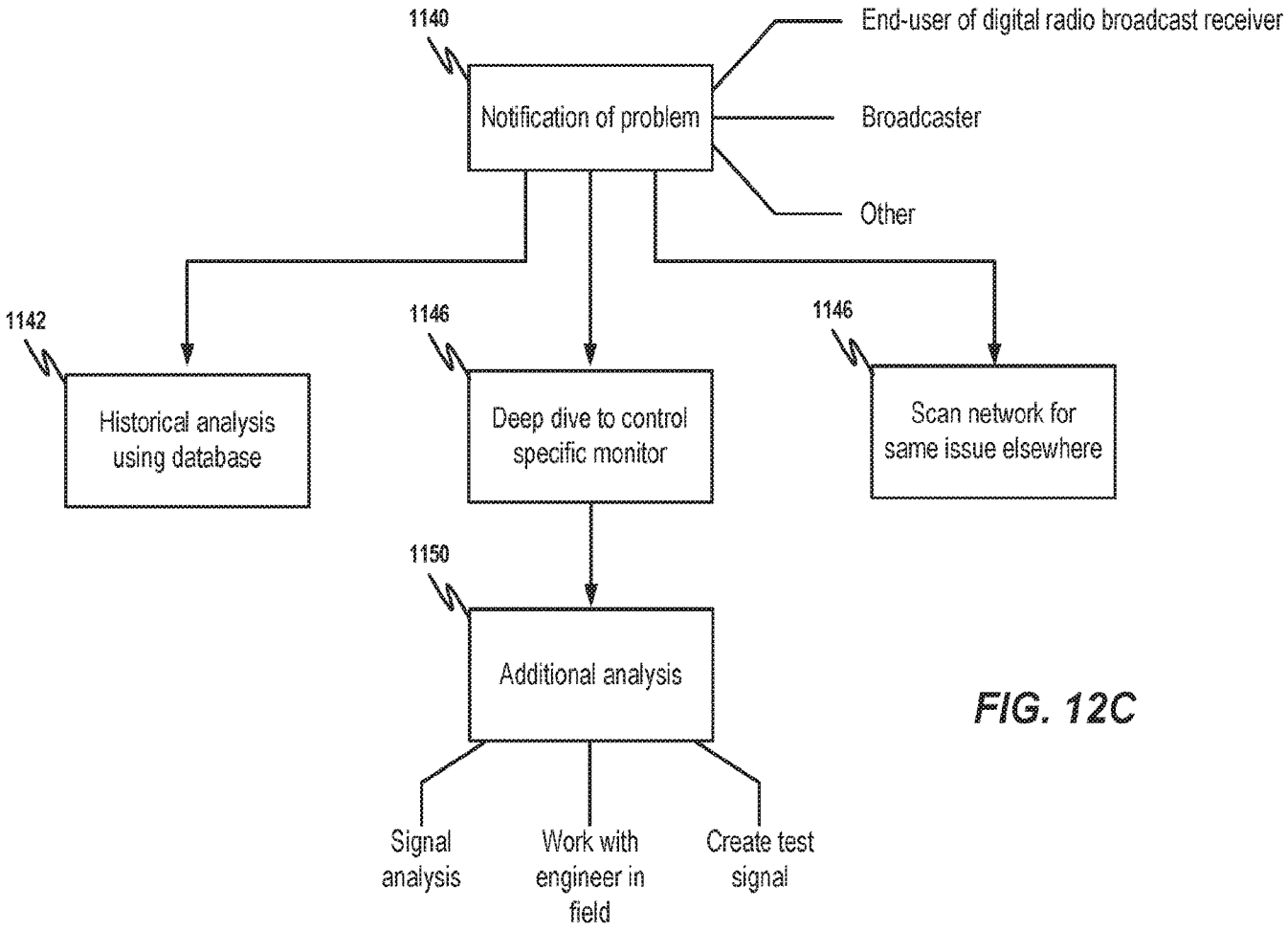

Embodiments described herein enable detection of signal quality problems and errors in digital radio broadcast signals in a proactive manner, i.e., the problems are detected near the time at which the problems first develop and are not known only based on reports from end-users, etc. In other embodiments, the systems and methods of the instant disclosure are used after a problem is reported by a third party (e.g., an end-user of a digital radio broadcast receiver system, manufacturer of digital radio broadcasting receiver systems or transmitter systems, car dealership, etc.). To illustrate these other embodiments, reference is made to FIG. 12C. This figure depicts a flowchart of an example process that may be performed by the system of FIG. 12A following the detection of a problem by a third party. Thus, as shown at the step 1140, the system of FIG. 12A or an operator of this system may receive a notification of the problem. As illustrated in FIG. 12C, the notification of the problem may be from an end-user, a radio broadcaster, or another entity.

After being informed of the problem at the step 1140, various different actions may be performed. In one embodiment, at step 1142, a historical analysis is performed using the database 1222. For instance, if it is reported that the problem occurred at a specific time for a particular radio station, it may be possible to analyze historical data stored in the database 1222 for the specific time and radio station. Such analysis may be performed in an automated manner (e.g., by the HD Radio Data Request and Filing Server 1220 or another computer-based system) or manually by humans and the analysis may provide information on the cause of the problem. For example, an error report may indicate that stuttering audio was encountered by an end-user on a specific date and time for a radio station. By analyzing historical data stored in the database 1222, it may be determined that the cause of the stuttering audio was a broadcasting problem and not a problem with the end-user's digital radio broadcast receiver. In embodiments, the database 1222 comprises a historical database of signal quality metrics that may be used to track trends on each radio station, such as to confirm that a particular issue has been fixed and does not occur again. In some embodiments, each piece of data stored in the database 1222 has an associated (i) date and time (e.g., indicative of when a signal was broadcasted, when the data was requested, and/or when the data was stored in the database 1222, etc.), (ii) broadcast frequency (e.g., indicative of a broadcast frequency associated with the piece of data), and (iii) local information (e.g., indicative of a location of a radio station associated with the piece of data). This assorted data may be stored in the database 1222. Thus, for example, for particular "signal strength" data stored in the database 1222, the database 1222 may also store a date, time, broadcast frequency, and location associated with the signal strength data. Storing such associated data enables the historical analysis described above and/or another analyses to be performed.

In other embodiments, after being informed of the problem at the step 1140, the deep dive functionality described above is utilized. Using the deep dive functionality, the OPS Deep Dive Front-end Server 1224 or HD Radio Data Request and Filing Server 1220 may communicate with the monitoring equipment 1230 to request all data available for the radio station associated with the reported error. The data available for the radio station may include all fields of digital audio data and data services transmitted by the station and all variables relating to signal quality attributes of received signals (e.g., variables relating to time alignment, level alignment, phase alignment, signal strength attributes, etc.). This data may be analyzed to diagnose a problem associated with the signals broadcasted by the radio station. Such analysis may be performed in an automated manner (e.g., by the OPS Deep Dive Front-end Server 1224 or another computer-based system) or manually by humans.

The deep dive analysis may be used to identify the source of the problem or it may support additional analysis efforts, as shown at step 1150 of FIG. 12C. For instance, if an error report indicates "radio not receiving station call sign data from WCBB 100.5 FM in Los Angeles, Calif.," the deep dive functionality can be used to instruct request all data available for this station from monitoring equipment located in this area. The requested data may be received at the HD Radio Request and Filing Server 1220 and/or OPS Deep Dive Front-end Server 1224 and may be stored in the database 1224. The received data can be analyzed to determine an exact configuration used by the radio station (e.g., identifying a service mode, power level, and other configuration parameters utilized by the station). Based on the determined configuration, a test signal can be generated. This test signal can be used to test different digital radio broadcast receivers (e.g., in a lab setting) to determine whether the receivers receive the station call sign data. From this analysis, it may be determined that the source of the problem is a particular type of digital radio broadcast receiver (e.g., if some receivers properly receive the call sign data from the test signal and others do not), and that the problem is not related to the radio station's transmitter system or broadcasting configuration.

The analysis performed at the step 1150 may include various types of signal analysis. For instance, if the same error report described above is received (e.g., "radio not receiving station call sign data from WCBB 100.5 FM in Los Angeles, Calif."), the data received as a result of the deep dive functionality may be analyzed in various ways. As noted above, this data may include all fields of digital audio data and data services transmitted by the transmitter and all variables relating to signal quality attributes of received signals. The data analysis may reveal, for example, that the broadcaster is in fact broadcasting the call sign data, and that the problem is related to a low received signal strength. Thus, by analyzing all of the data received from the deep dive functionality, data relating to the signal strength attribute may reveal a potential cause of the problem.

In some embodiments, the analysis performed at the step 1150 may be performed in conjunction with work performed by an engineer in the field. For instance, an error report may indicate that a digital radio broadcast receiver is unexpectedly shutting down when receiving signals from a particular radio station. The deep dive functionality can be used to instruct monitoring equipment in this area to receive all data from the particular station. Simultaneously, an engineer in the field can monitor the digital radio broadcast receiver and identify an exact time or times that the receiver unexpectedly shut down. Data corresponding to the shutdown time or times can be analyzed. This analysis may identify a radio station configuration or field in the broadcasted data that is the cause of the unexpected shutdowns. Alternatively, for instance, a test signal can be created based on the received data, and the test signal can then be tested on a variety of different types of digital radio broadcast receivers, including the type of receiver that is experiencing the shutdowns. Using the test data, the error may be recreated in a lab setting. This analysis using the test signal may reveal that the cause of the problem is related to the particular digital radio broadcast receiver and is not related to the data being broadcasted.

In other embodiments, after being informed of the problem at the step 1140, the system of FIG. 12A may perform actions to determine if similar issues exist elsewhere (e.g., in other parts of the country, other parts of the world, etc.), as shown at step 1146 of FIG. 12C. This analysis may be the same or similar to that described above with reference to step 1132 of FIG. 12B.

Figure 13:
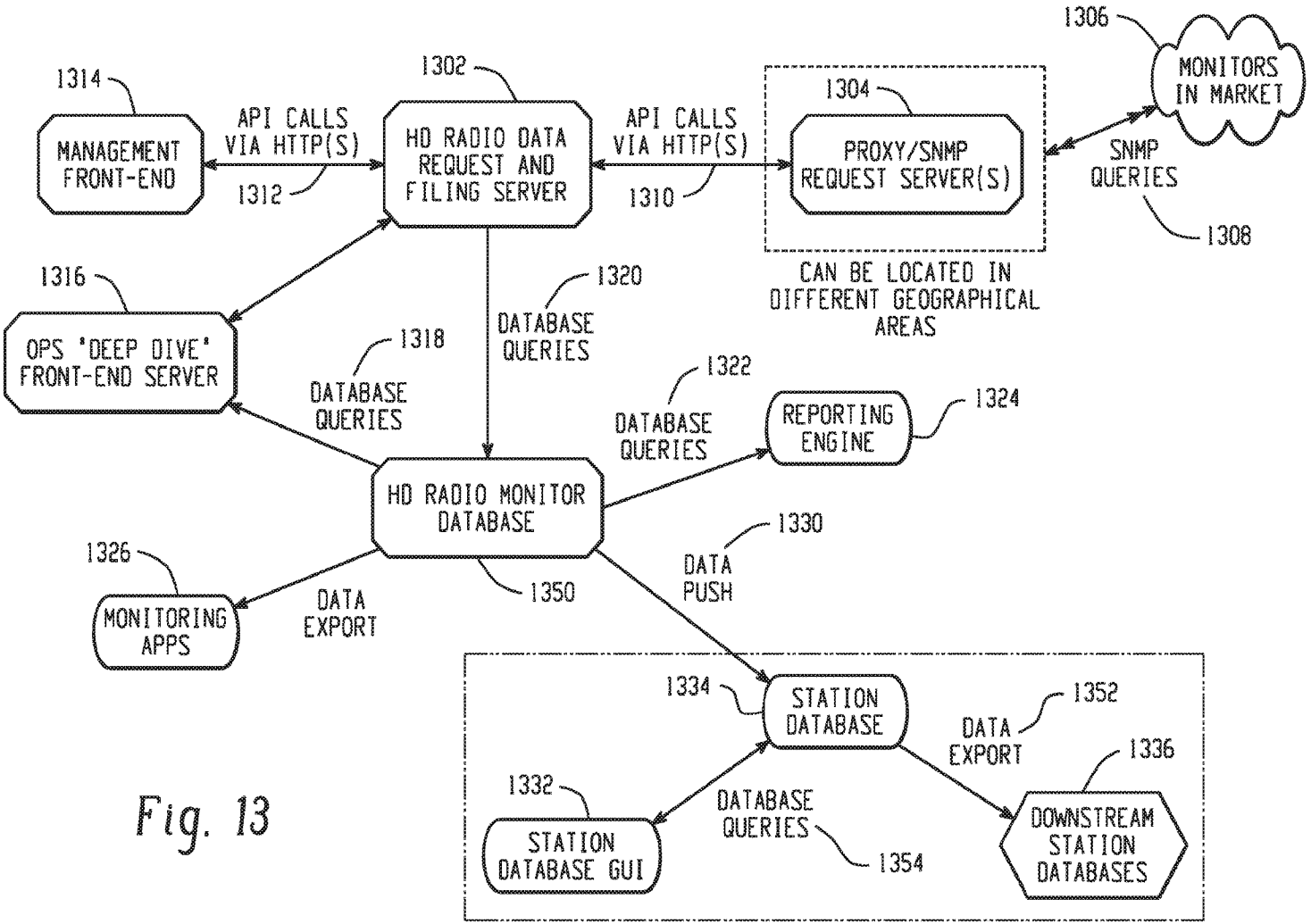
FIG. 13 is a block diagram depicting additional details of the system of FIG. 12A.

FIG. 13 is a block diagram depicting an example system for automated detection of signal quality problems and errors in digital radio broadcast signals. The system may enable proactive detection of signal quality problems and errors by putting monitors 1306 in multiple radio markets around the world. The system may be an automated system that scans all frequencies in those markets at all times (e.g., 24 hours a day, 7 days a week) and provides alerts about various detected issues (e.g., signal quality problems, signals' non-compliance with standards, missing or incorrect content, etc.) that could affect a user's experience. The system may enable monitoring equipment to be controlled remotely to perform a "deep dive" in real-time to analyze a station and thereby help the station in solving deeper issues that the station may be experiencing. This system includes multiple elements to enable both routine, remote monitoring of radio stations in various markets and also the deep dive monitoring and diagnostics on individual stations in those markets.

Each market can have one or multiple radio monitors 1306. Each monitor 1306 may include hardware (e.g., an antenna, etc.) that is configured to receive a digital radio broadcast signal. Such hardware may include, for example, components illustrated in FIGS. 7, 8, and 10 described above. The hardware may also be based on HD Radio Reference designs. Proxy/SNMP Request Servers 1304 may communicate with the monitors 1306 using SNMP queries 1308. SNMP is a protocol that may be used to manage devices on IP networks. SNMP is designed to use management information bases (MIBs), which in this case utilize custom structure designs to describe the structure of management data of a device subsystem. The MIB used herein enables the accessing of all the different parameters and fields needed to fully analyze the AM, FM, and HD Radio signals of a radio station. Thus, a monitor 1306 receives an MIB from a Proxy/SNMP Request Server 1304, and the MIB serves as a request that requests certain data from the monitor 1306 (e.g., 89.1 FM, HD1 Audio, Time Alignment data, etc.).

The Proxy/SNMP Request Servers 1304 enable efficient communications with the monitors 1306 in the field. Since the monitors 1306 may be positioned all over the world, the Proxy/SNMP Request Servers 1304 may be located locally to the monitors 1306 (or near-locally to the monitors 1306), thus enabling each of the servers 1304 to communicate with one or more monitors 1306 in an efficient manner. The Proxy/SNMP Request Servers 1304 act as intermediaries between the HD Radio Data Request and Filing Server 1302 and the monitors 1306. Thus, a request for data is transmitted from the HD Radio Data Request and Filing Server 1302 to a Proxy/SNMP Request Server 1304, and the Proxy/SNMP Request Server 1304 then transmits this request to a monitor 1306. The requested data is transmitted from the monitor 1306 to the Proxy/SNMP Request Server 1304, and the Proxy/SNMP Request Server 1304 then transmits this data to the HD Radio Data Request and Filing Server 1302. SNMP requests 1308 travel back and forth between the Proxy/SNMP Request Server 1304 and the monitors 1306 with which the Proxy/SNMP Request Server 1304 is associated. The Proxy/SNMP Request Servers 1304 may be used purely for communication with the monitors 1306, and the servers 1304 may get all their requests from the HD Radio Data Request and Filing Server 1302. In embodiments, the data gathered by the monitors 1306 positioned across the world may be used for various purposes that do not involve detection of signal quality problems and errors in broadcast digital radio broadcast signals (e.g., automatically updating information in a mobile application, such as a "station guide" mobile app, automatically updating a database of images used by receivers, etc.). In embodiments, as data is collected from the monitoring equipment, this data is compared to existing data stored in a station database. When the existing data does not match the new data, data in the database is updated based on the new data. In embodiments, the data of the database may be used by mobile applications and head units in receivers for station logs, station information such as call-signs, etc, and/or other data.

The HD Radio Data Request and Filing Server 1302 may be known as the "brains" of the system. The server 1302 performs multiple functions, in an embodiment. The HD Radio Data Request and Filing Server 1302 may provide tuning directions (e.g., requests for data associated with a particular tuning frequency) to the monitors 1306 in all markets using API calls 1310 via HTTP(S) to the Proxy/SNMP Request Servers 1304. The HD Radio Data Request and Filing Server 1302 may also perform load balancing operations related to the Proxy/SNMP Request Servers 1304. For example, a Proxy/SNMP Request Server 1304 may communicate with multiple monitors 1306 within a market or region. Rather than overwhelm one of the monitors 1306 with requests (while sending no requests or few requests to other monitors 1306), the HD Radio Data Request and Filing Server 1302 may enable load balancing, such that the Proxy/SNMP Request Server 1304 distributes requests among the multiple monitors in the market.

The HD Radio Data Request and Filing Server 1302 may further collect all requested data from the various markets via the Proxy/SNMP Request Servers 1304. Initial analysis and tabulation of the requested data may be performed at the HD Radio Data Request and Filing Server 1302. For example, the HD Radio Data Request and Filing Server 1302 may be configured to analyze the received data to detect signal quality problems and errors in digital radio broadcast signals received at the monitors 1306. The HD Radio Data Request and Filing Server 1302 may be configured to perform such analysis in an automated manner that requires no human intervention or minimal human intervention. In an example, the analysis includes comparing the data received from the monitors 1306 to (i) one or more predetermined threshold values, (ii) data indicative of a baseline standard for signals broadcasted according to a standard, and/or (iii) data indicative of expected content of broadcasted signals. In an example, the HD Radio Data Request and Filing Server 1302 performs the analysis in real-time or near real-time, i.e., near the time at which the digital radio broadcast signal is broadcast, thus enabling signal quality problems and errors to be detected and corrected soon after the problems and errors develop.

The HD Radio Data Request and Filing Server 1302 may further be configured to send data 1320 to the HD Radio Monitor Database 1350. Such data 1320 may include "raw" data (e.g., data received from the monitors 1306 that has not been tabulated or otherwise processed) or processed data (e.g., data that has been tabulated and/or processed by the HD Radio Data Request and Filing Server 1302). The HD Radio Data Request and Filing Server 1302 may further perform normalization of data received from monitors 1306 when the monitors 1306 have different gain values (e.g., due to the different types of antennas used by the monitors 1306 in the various markets).

The HD Radio Data Request and Filing Server 1302 may also enable the OPS "Deep Dive" Front-End Server 1316 to take control of a monitor in an individual market (e.g., in order to receive particular data, in real-time or near real-time, from the monitor, etc.). The OPS "Deep Dive" Front-End Server 1316 may monitor and analyze data in the HD Radio Monitor Database 1350 via database queries 1318, and then take control of a monitor based on a condition detected in the monitored data. All data received at the HD Radio Data Request and Filing Server 1302 from the monitors 1306 in the field may be stored in the HD Radio Monitor Database 1350 (e.g., stored indefinitely). The HD Radio Data Request and Filing Server 1302 may also be controlled via a management front-end 1314. The management front-end 1314 may be used, for example, to program the server 1302 to carry out the monitoring and analysis described herein.

A reporting engine 1324 may be configured to perform analysis of historical data. For example, while the HD Radio Data Request and Filing Server 1302 may be configured to monitor and analyze data in real-time or near real-time, the reporting engine 1324 may receive data from the HD Radio Monitor Database 1350 (e.g., using database queries 1322), where the data is analyzed to make determinations about digital radio broadcast signal transmission over time (e.g., analyzing data received over the course of a day, a week, a month, a year, etc.). As described herein, the HD Radio Data Request and Filing Server 1302 may be configured detect a signal quality problem by comparing received data from monitors 1306 to various data (e.g., threshold values, etc.). In an example, the system may learn to adjust the threshold values based on the analysis of historical data. The historical data may be used in various other ways. For example, the historical data for a station may include a station logo that is associated with the station. If the station broadcasts a new logo, then the previous station logo may be replaced with the new logo.

Since stations in multiple markets may be monitored continuously (e.g., 24 hours a day, 7 days a week), monitoring applications (i.e., "monitoring apps") 1326 may be used by radio station owners or engineers to receive notifications about problems (e.g., signal quality problems) associated with radio stations. The notifications may come via the app, SMS, or email depending on the level and severity of the problem. Additionally, data 1330 may be pushed from the HD Radio Monitor Database 1350 to a station database 1334 associated with a radio station. Data 1352 may be exported from the station database 1350 to one or more downstream station databases 1336. A station database graphical user interface (GUI) 1332 may receive data from the station database 1334 based on database queries 1354 and present the received data in a way that can be easily perceived and understood by humans. For example, the GUI 1332 may use graphics or illustrations to indicate a presence or absence of signal quality problems and errors in a digital radio broadcast signal transmitted by the radio station.

Figure 14:
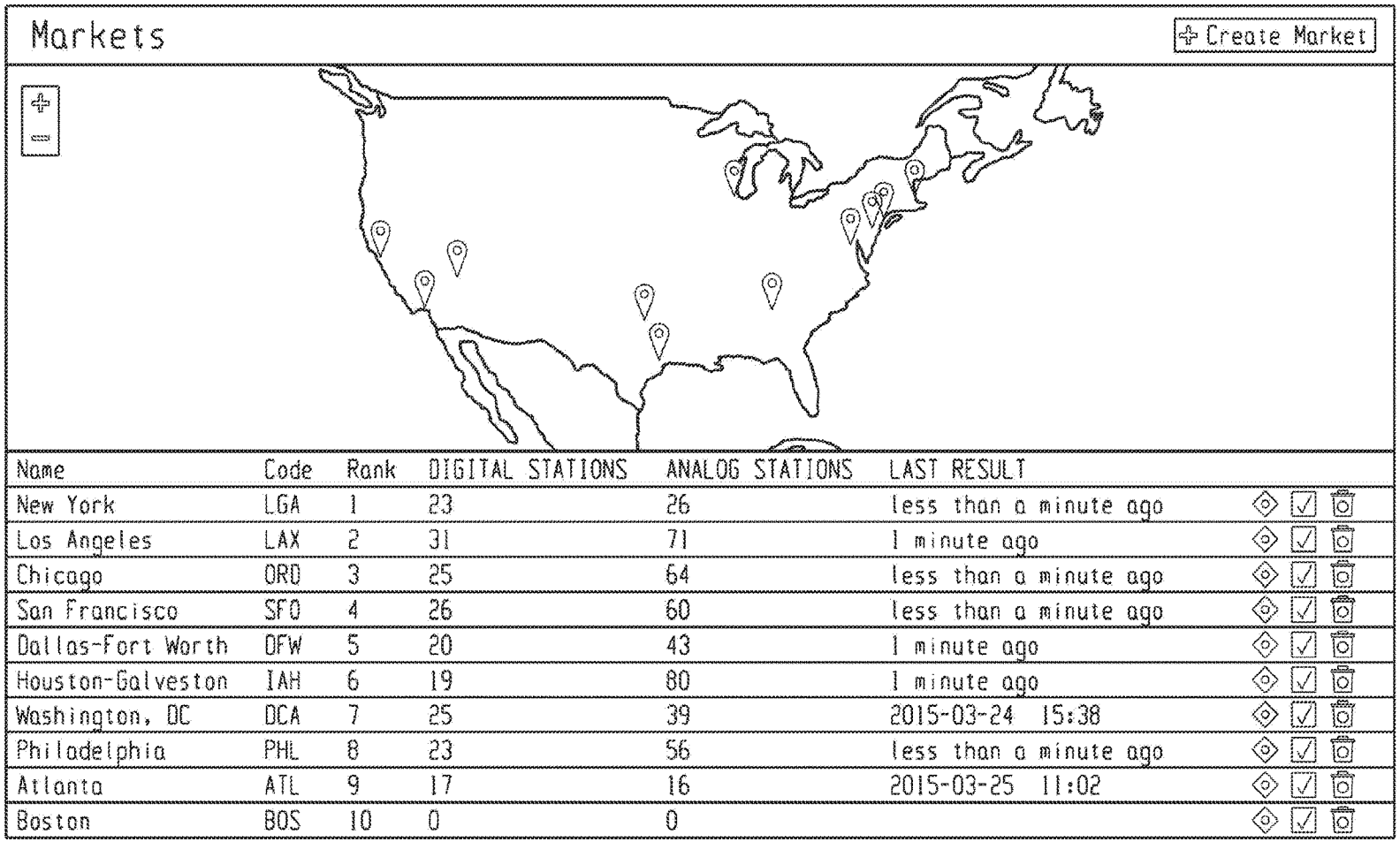
Figure 15:
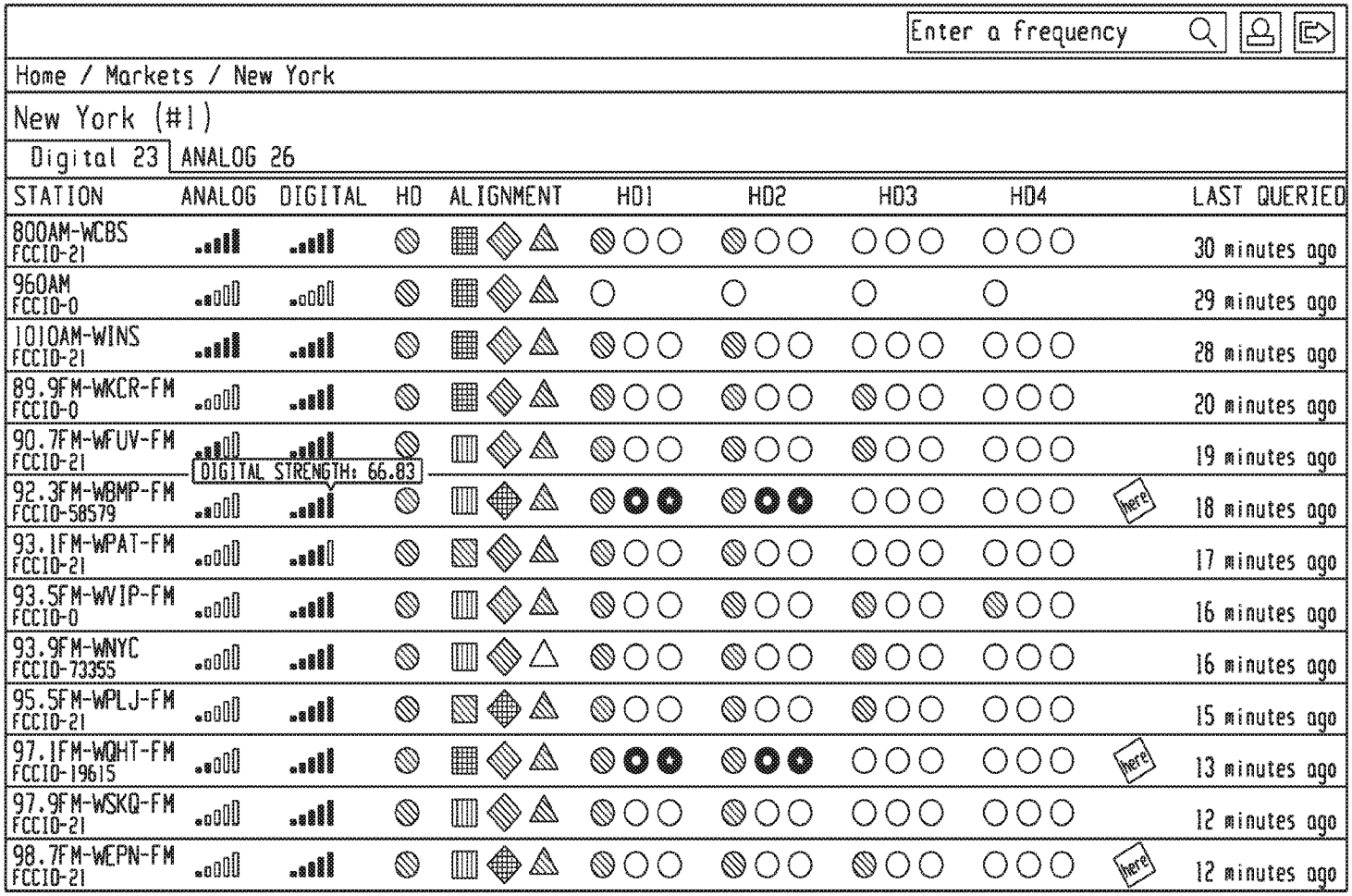

FIGS. 14-16 are exemplary screenshots of a GUI that may be used to present (i) data received at the HD Radio Data Request and Filing Server, and (ii) results of an analysis of that data. As described herein, the HD Radio Data Request and Filing Server is configured to (i) transmit requests for data to monitoring equipment, the requested data being indicative of one or more attributes of a digital radio broadcast signal received at the monitoring equipment, (ii) receive the requested data from the monitoring equipment, and (iii) analyze in real-time or near real-time the received data, the data being analyzed to detect signal quality problems and errors in the digital radio broadcast signals received at the monitoring equipment. To make the received data and the results of the analysis of that data more understandable to humans, the GUI illustrated in FIGS. 14-16 may be used.

In FIG. 14, the GUI depicts a map of the top ten radio markets in the United States. The map includes "pins" that show the locations of the top ten markets. Below the map, the GUI displays (i) names of the top ten markets (e.g., New York, Los Angeles, etc.), (ii) identifying codes for each of the markets, (iii) a ranking for each of the markets, (iv) a number of digital radio stations in each of the markets, (v) a number of analog stations in each of the markets, and (vi) a time at which data was last received from monitoring equipment in each of the markets.

In FIG. 15, the GUI depicts information for a selected market. In this figure, the "New York" market illustrated in the example of FIG. 14 is selected. A "Digital" tab is selected, and thus, the GUI depicts information on digital radio stations included in the market. For each station, a digital and analog signal strength is shown, and an indicator shows whether the station has an "HD Radio" capability. For each station, three "alignment" images are depicted. A first image relates to "time alignment" of the station's digital radio broadcast signals, a second image relates to "level alignment" of the station's signals, and a third image relates to "phase alignment" of the station's signals. These signal quality attributes are described above.

For each of the three alignment images, a characteristic of the image (e.g., a color, etc.) indicates a quality of the alignment. Thus, for example, if a time alignment image is red in color, this may indicate that the station's digital radio broadcast signal has a signal quality problem related to time alignment. By contrast, if the time alignment image is yellow in color, this may indicate that the signal is acceptable with respect to time alignment, and if the time alignment image is green in color, this may indicate that the signal is very good with respect to time alignment. Alerts or alarms may be generated based on such signal statuses. In an example, there are several levels of alerts/alarms. When "highly critical" thresholds are surpassed (e.g., as indicated by images having the color red) certain parties may be notified via alerts or alarms, and when less critical thresholds are surpassed (e.g., as indicated by images having the yellow color), other parties may be notified via alerts or alarms.

In FIG. 15, for each of the stations, additional data may be presented. Such data may include indicators relating to each of HD1, HD2, HD3, and HD4 audio (e.g., signal strength, etc.). For each of the stations, the GUI may further provide an indication of when data was last received for the station. In other embodiments, additional data related to the stations' signals may be presented. Such data may indicate whether the station's signals are compliant with applicable standards and/or include expected content.

In FIG. 16, the GUI depicts information for a selected radio station. In this figure, the "92.3 FM—WBMP-FM" market illustrated in the example of FIG. 15 is selected. The GUI displays detailed information on the selected radio station, including numerical values for the time alignment, level alignment, phase alignment, analog signal strength, and digital signal strength. The detailed information further includes, for each of the HD Radio audio channels (e.g., HD1, HD2, HD3, HD4, etc.) a title of a song, an artist associated with the song, an album name associated with the song, and a program type (e.g., "Top 40," "Country," "Hip Hop," etc.), among other data. All data shown in FIGS. 15 and 16 may be based on monitoring data received at a HD Radio Data Request and Filing Server from various monitoring equipment. The GUI of FIG. 16 further allows a user to display historical information and data associated with the selected station. Thus, while the information and data illustrated in the example of FIG. 16 may be for a "Latest Result," i.e., based on the most recent data received for the station, the GUI also presents clickable links or buttons for displaying historical data. For example, a user may be able to click a link "About 1 hour ago" to display information and data for the station that was received in this previous timeframe.

Figure 17:
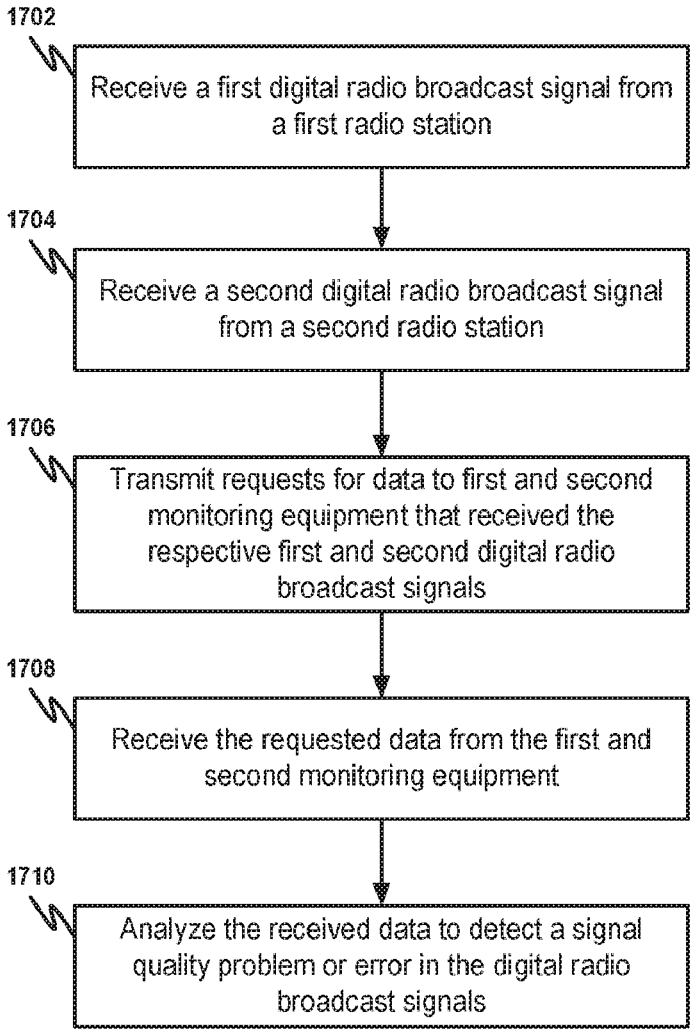
FIG. 17 is a flowchart depicting operations of an example method for automated detection of signal quality problems and errors in digital radio broadcast signals.

FIG. 17 is a flowchart depicting operations of an example method for automated detection of signal quality problems and errors in digital radio broadcast signals. At 1702, a digital radio broadcast signal is received via digital radio broadcast transmission from a first radio station. The signal is received using first monitoring equipment located in an over-the-air coverage area of the first radio station. At 1704, a digital radio broadcast signal is received via digital radio broadcast transmission from a second radio station, where the signal is received using second monitoring equipment located in an over-the-air coverage area of the second radio station. The over-the-air coverage areas of the first and second radio stations are geographically separated and do not overlap. At 1706, requests for data are transmitted to the first monitoring equipment and the second monitoring equipment. The requested data is indicative of one or more attributes of a digital radio broadcast signal received at respective monitoring equipment. At 1708, the requested data are received from the first and second monitoring equipment. At 1710, the received data from the first and second monitoring equipment are analyzed in real-time or near real-time. The data are analyzed in an automated manner to detect a signal quality problem or error in the digital radio broadcast signals received at the first and second monitoring equipment.

The exemplary approaches described may be carried out using any suitable combinations of software, firmware and hardware and are not limited to any particular combinations of such. Computer program instructions for implementing the exemplary approaches described herein may be embodied on a non-transitory computer-readable storage medium, such as a magnetic disk or other magnetic memory, an optical disk (e.g., DVD) or other optical memory, RAM, ROM, or any other suitable memory such as Flash memory, memory cards, etc.

Additionally, the disclosure has been described with reference to particular embodiments. However, it will be readily apparent to those skilled in the art that it is possible to embody the disclosure in specific forms other than those of the embodiments described above. The embodiments are merely illustrative and should not be considered restrictive. The scope of the disclosure is given by the appended claims, rather than the preceding description, and all variations and equivalents which fall within the range of the claims are intended to be embraced therein.

What is claimed is:

1. A system for automated detection of signal quality problems and errors in digital radio broadcast signals, the digital radio broadcast signals being transmitted by multiple different radio stations having different over-the-air coverage areas, the system comprising:

a computing system configured to:

receive data from respective first and second monitoring equipment having different air coverage areas, the data being indicative of one or more attributes of a digital radio broadcast signal received at the respective first or second monitoring equipment, and analyze in real-time or near real-time the received data from the first and second monitoring equipment, the data being analyzed in an automated manner to detect a signal quality problem or error in the digital radio broadcast signals received at the first and second monitoring equipment.

2. The system of claim 1, wherein the computing system is configured to analyze the data received from the first and second monitoring equipment simultaneously.

3. The system of claim 1, wherein the computing system is configured to generate an alert signal or alarm signal based on a detection of the signal quality problem or the error.

4. The system of claim 1, wherein the received data is indicative of a signal strength, a time alignment, a level alignment, or a phase alignment of a digital radio broadcast signal received at respective monitoring equipment.

5. The system of claim 4, wherein the computing system is configured to detect the signal quality problem by comparing data received from the first or second monitoring equipment to a threshold value.

6. The system of claim 1, wherein the computing system is configured to detect the error by comparing data received from the first or second monitoring equipment to data indicative of an expected content of digital radio broadcast signals.

7. The system of claim 6, wherein the expected content includes textual information and image information.

8. The system of claim 1, wherein the computing system is configured to detect the error by comparing data received from the first or second monitoring equipment to data indicative of a standard for digital radio broadcasting.

9. The system of claim 8, wherein the standard is the NRSC-5C standard.

10. The system of claim 1, wherein the received data is indicative of one or more fields of data included in a digital radio broadcast signal received at respective monitoring equipment.

11. The system of claim 10, wherein the one or more fields of data include a text field, and the computing system is configured to detect the error by determining whether the text field exceeds a predetermined, maximum length.

12. The system of claim 10, wherein the computing system is configured to detect the error by determining whether the fields of data are populated.

13. The system of claim 10, wherein the computing system is configured to detect the error by determining whether the fields of data are populated with data that is appropriate for each of the fields.

14. The system of claim 1, wherein the computing system is configured to detect the error by analyzing the received data to determine whether the digital radio broadcast signals received at the respective monitoring equipment include periods of silence that are longer than a predetermined length of time.

15. The system of claim 1, wherein the computing system is configured to detect the error by analyzing the received data to determine whether audio data and non-audio data are synchronized in time in the digital radio broadcast signals received at the respective monitoring equipment.

16. A method for detection of signal quality problems and errors in digital radio broadcast signals, the digital radio broadcast signals being transmitted by multiple different radio stations having different over-the-air coverage areas, the method comprising:

receiving data from respective first and second monitoring equipment having different air coverage areas, the data being indicative of one or more attributes of a digital radio broadcast signal received at the respective first or second monitoring equipment; and analyzing in real-time or near real-time the received data from the first and second monitoring equipment to detect a signal quality problem or error in the digital radio broadcast signals received at the first and second monitoring equipment.

17. The method of claim 16, wherein the data received from the first and second monitoring equipment are analyzed simultaneously.

18. The method of claim 16, further comprising:

generating an alert signal or alarm signal based on a detection of the signal quality problem or the error.

19. The method of claim 16, wherein the received data is indicative of a signal strength, a time alignment, a level alignment, or a phase alignment of a digital radio broadcast signal received at respective monitoring equipment.

20. The method of claim 19, wherein the analyzing of the received data comprises comparing data received from the first or second monitoring equipment to a threshold value to detect the signal quality problem.

* * * * *